US010208404B2

(12) United States Patent
Kay et al.

(10) Patent No.: US 10,208,404 B2
(45) Date of Patent: Feb. 19, 2019

(54) MICRO AND NANOFIBERS OF POLYSACCHARIDE BASED MATERIALS

(71) Applicant: CLARCOR Inc., Franklin, TN (US)

(72) Inventors: Stephen Kay, Austin, TX (US); Yogesh Ner, McAllen, TX (US); Yatinkumar Narayan Rane, McAllen, TX (US)

(73) Assignee: CLARCOR Inc., Franklin, TN (US)

( * ) Notice: Subject to any disclaimer, the term of this patent is extended or adjusted under 35 U.S.C. 154(b) by 556 days.

(21) Appl. No.: 14/848,888

(22) Filed: Sep. 9, 2015

(65) Prior Publication Data

US 2016/0069000 A1 Mar. 10, 2016

Related U.S. Application Data

(60) Provisional application No. 62/048,048, filed on Sep. 9, 2014.

(51) Int. Cl.

| | |
|---|---|
| ***C08B 3/22*** | (2006.01) |
| ***D01D 1/02*** | (2006.01) |
| ***D01D 1/10*** | (2006.01) |
| ***D01D 5/04*** | (2006.01) |
| ***D01D 7/00*** | (2006.01) |
| ***D01D 7/02*** | (2006.01) |
| ***D01F 2/00*** | (2006.01) |
| ***D01F 2/02*** | (2006.01) |
| ***D01F 2/24*** | (2006.01) |
| ***D01F 2/30*** | (2006.01) |
| ***D01D 5/18*** | (2006.01) |
| *D01F 9/00* | (2006.01) |

(52) U.S. Cl.

CPC ..... *D01F 2/30* (2013.01); *D01D 1/106* (2013.01); *D01D 5/18* (2013.01); *D01F 9/00* (2013.01)

(58) Field of Classification Search

CPC ... C08B 3/22; D01D 1/02; D01D 1/10; D01D 1/106; D01D 5/04; D01D 5/18; D01D 7/00; D01D 7/02; D01F 2/00; D01F 2/02; D01F 2/24; D01F 2/28; D01F 2/30

USPC ..... 264/8, 211.1, 211.11, 211.12, 310, 311; 106/168.01; 536/124, 127

See application file for complete search history.

(56) References Cited

U.S. PATENT DOCUMENTS

| | | | | |
|---|---|---|---|---|
| 2013/0300012 | A1* | 11/2013 | Padron | D01D 5/18 264/8 |
| 2014/0035177 | A1* | 2/2014 | Lipton | D01D 5/18 264/8 |
| 2014/0167329 | A1* | 6/2014 | L'Abee | D01D 5/18 264/211.1 X |
| 2015/0101979 | A1* | 4/2015 | Joo | D01D 5/18 210/500.1 |

* cited by examiner

*Primary Examiner* — Leo B Tentoni

(74) *Attorney, Agent, or Firm* — Reinhart Boerner Van Deuren P.C.

(57) ABSTRACT

Described herein are apparatuses and methods of creating fibers, such as microfibers and nanofibers, that are composed of saccharides. The methods discussed herein employ centrifugal forces to transform saccharide material into fibers. Apparatuses that may be used to create saccharide fibers are also described. Fiber producing devices with features that enhance fiber production and adaptability to different types of fiber are described.

16 Claims, 13 Drawing Sheets

MICRO AND NANOFIBERS OF POLYSACCHARIDE BASED MATERIALS

PRIORITY CLAIM

This application claims priority to U.S. Provisional Application Ser. No. 62/048,048 entitled "Micro and nanofibers of polysaccharide based materials" filed Sep. 9, 2014, which is incorporated herein by reference in its entirety.

BACKGROUND OF THE INVENTION

1. Field of the Invention

The present invention generally relates to the field of fiber production. More specifically, the invention relates to fibers of micron and sub-micron size diameters.

2. Description of the Relevant Art

Fibers having small diameters (e.g., micrometer ("micron") to nanometer ("nano")) are useful in a variety of fields from the clothing industry to military applications. For example, in the biomedical field, there is a strong interest in developing structures based on nanofibers that provide scaffolding for tissue growth to effectively support living cells. In the textile field, there is a strong interest in nanofibers because the nanofibers have a high surface area per unit mass that provide light, but highly wear resistant, garments. As a class, carbon nanofibers are being used, for example, in reinforced composites, in heat management, and in reinforcement of elastomers. Many potential applications for small-diameter fibers are being developed as the ability to manufacture and control their chemical and physical properties improves.

It is well known in fiber manufacturing to produce extremely fine fibrous materials of organic fibers, such as described in U.S. Pat. Nos. 4,043,331 and 4,044,404, where a fibrillar mat product is prepared by electrostatically spinning an organic material and subsequently collecting spun fibers on a suitable surface; U.S. Pat. No. 4,266,918, where a controlled pressure is applied to a molten polymer which is emitted through an opening of an energy charged plate; and U.S. Pat. No. 4,323,525, where a water soluble polymer is fed by a series of spaced syringes into an electric field including an energy charged metal mandrel having an aluminum foil wrapper there around which may be coated with a PTFE (Teflon™) release agent. Attention is further directed to U.S. Pat. Nos. 4,044,404, 4,639,390, 4,657,743, 4,842,505, 5,522,879, 6,106,913 and 6,111,590—all of which feature polymer nanofiber production arrangements.

Electrospinning is a major manufacturing method to make nanofibers. Examples of methods and machinery used for electrospinning can be found, for example, in the following U.S. Pat. Nos. 6,616,435; 6,713,011; 7,083,854; and 7,134,857.

SUMMARY OF THE INVENTION

Described herein are apparatuses and methods of creating fibers from saccharide materials, such as microfibers and nanofibers. The methods discussed herein employ centrifugal forces to transform saccharide materials into fibers.

In an embodiment, a method of producing microfibers and/or nanofibers includes:

placing a composition into a fiber producing device comprising one or more openings, wherein the composition comprises a polysaccharide, a carrier and a solvent capable of dissolving at least a portion of the polysaccharide and the carrier;

rotating the fiber producing device about a spin axis such that rotation of the fiber producing device causes the composition disposed in the fiber producing device to be ejected through the one or more of the openings and form fibers comprising the polysaccharide as the ejected composition solidifies; and collecting the produced microfibers and/or nanofibers.

In some embodiments, the fibers produced have an average diameter ranging from about 300 nm to about 20 microns.

In one embodiment, the polysaccharide is a cellulose ester (e.g., cellulose acetate). In an alternate embodiment, the polysaccharide is chitosan. In some embodiments, the solvent is acetone. In an alternate embodiment, the solvent may be a mixture of acetone and dimethylacetamide, or formic acid and DMF.

In an embodiment, the carrier is a carrier polymer. In another embodiment, the carrier is a plasticizer. In another embodiment, the carrier comprises a carrier polymer and a plasticizer.

The weight % ratio of polysaccharide to polyethylene oxide in the composition ranges from about 50:50 to about 99:1. The weight % of polysaccharide/polyethylene oxide to solvent ranges from 2% to about 30%.

In an embodiment, the method also includes: forming the composition of the polysaccharide and the polyethylene oxide in the solvent by mixing the components at a temperature of between about 25° C. and 100° C. for a time of about 1 hour to about 8 hours; and filtering the formed composition through a wire mesh having micron rating of between about 2 microns to about 50 microns.

In some embodiments, conditioning of the composition is performed by heating the composition to a processing temperature and allowing the composition to remain at the processing temperature for a time of about 30 minutes to about 5 hours. In some embodiments, the conditioning temperature is a temperature of between about 25° C. and 100° C. During conditioning the composition may be left for a time of about 30 minutes to about 5 hours prior to placing the composition into the fiber producing device.

In an embodiment, a fiber producing device is heated to a temperature sufficient to maintain the temperature of the material disposed in the fiber producing device at a temperature above about 25° C.

The fiber producing device may include one or more openings having a diameter ranging from about 100 microns to about 500 microns. The shape of the body of the fiber producing device creates a predefined airflow in a region proximate to the openings.

In an embodiment, the method includes positioning at least a portion of a substrate on a substrate support located below the fiber producing device; and producing microfibers and/or nanofibers with the fiber producing device such that the microfibers and/or nanofibers are deposited onto at least a portion of the substrate. The substrate support may include one or more openings that pass through at least a portion of the substrate support, wherein one or more openings are coupled to a vacuum, and wherein the method further comprises applying a vacuum to the substrate support. A substrate transfer system may be coupled to the substrate support to move at least a portion of a substrate over the substrate support. In one embodiment, the substrate support comprises an electrostatic plate. In an embodiment, the method includes activating a pressurized gas producing and distribution system, wherein the pressurized gas producing and distribution system creates a gas flow that directs the formed microfibers and/or nanofibers toward a substrate disposed in the substrate support.

In an embodiment, the viscosity of the composition may be altered to a preselected viscosity by altering the ratio of polysaccharide/polyethylene oxide to solvent prior to placing the composition in the fiber producing device, wherein the preselected viscosity produces fibers having a predetermined average diameter.

BRIEF DESCRIPTION OF THE DRAWINGS

Advantages of the present invention will become apparent to those skilled in the art with the benefit of the following detailed description of embodiments and upon reference to the accompanying drawings, in which.

Figure 1A:
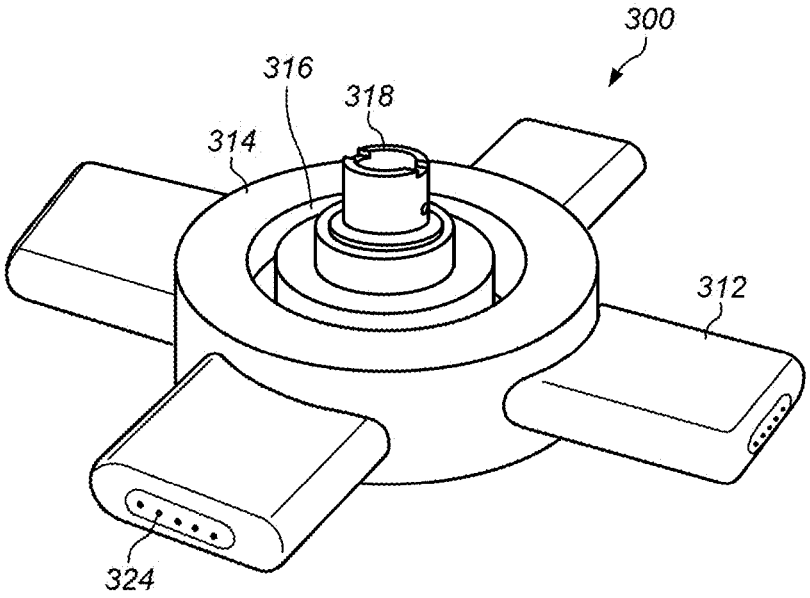
FIG. 1A depicts an embodiment of a body of a fiber producing device with four external draft members.

While the invention may be susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but to the contrary, the intention is to cover all modifications, equivalents, and alternatives falling within the spirit and scope of the present invention as defined by the appended claims.

DETAILED DESCRIPTION OF THE PREFERRED EMBODIMENTS

It is to be understood the present invention is not limited to particular devices or methods, which may, of course, vary. It is also to be understood that the terminology used herein is for the purpose of describing particular embodiments only, and is not intended to be limiting. As used in this specification and the appended claims, the singular forms "a", "an", and "the" include singular and plural referents unless the content clearly dictates otherwise. Furthermore, the word "may" is used throughout this application in a permissive sense (i.e., having the potential to, being able to), not in a mandatory sense (i.e., must). The term "include," and derivations thereof, mean "including, but not limited to." The term "coupled" means directly or indirectly connected.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a method or apparatus that "comprises," "has," "includes" or "contains" one or more steps or elements possesses those one or more steps or elements, but is not limited to possessing only those one or more steps or elements. Likewise, an element of an apparatus that "comprises," "has," "includes" or "contains" one or more features possesses those one or more features, but is not limited to possessing only those one or more features.

Described herein are apparatuses and methods of creating fibers, such as microfibers and nanofibers. The methods discussed herein employ centrifugal forces to transform material into fibers. Apparatuses that may be used to create fibers are also described. Some details regarding creating fibers using centrifugal forces may be found in the following U.S. Patent Application Publication Nos: 2009/0280325 entitled "Methods and Apparatuses for Making Superfine Fibers" to Lozano et al.; 2009/0280207 entitled "Superfine Fiber Creating Spinneret and Uses Thereof" to Lozano et al.; 2014/0042651 entitled "Systems and Methods of Heating a Fiber Producing Device" to Kay et al.; 20140159262 entitled "Devices and Methods for the Production of Microfibers and Nanofibers in a Controlled Environment" to Kay et al. 2014/0035179 entitled "Devices and Methods for the Production of Microfibers and Nanofibers" and U.S. Pat. No. 8,721,319 entitled "Superfine Fiber Creating Spinneret and Uses Thereof" to Lozano et al.; U.S. Pat. No. 8,231,378 entitled "Superfine Fiber Creating Spinneret and Uses Thereof" to Lozano et al.; U.S. Pat. No. 8,647,540 entitled "Apparatuses Having Outlet Elements and Methods for the Production of Microfibers and Nanofibers" to Peno; U.S. Pat. No. 8,777,599 entitled "Multilayer Apparatuses and Methods for the Production of Microfibers and Nanofibers" to Peno et al.; U.S. Pat. No. 8,658,067 entitled "Apparatuses and Methods for the Deposition of Microfibers and Nanofibers on a Substrate" to Peno et al.; U.S. Pat. No. 8,647,541 entitled "Apparatuses and Methods for Simultaneous Production of Microfibers and Nanofibers" to Peno et al.; U.S. Pat. No. 8,778,240 entitled "Split Fiber Producing Devices and Methods for the Production of Microfibers and Nanofibers" to Peno et al.; and U.S. Pat. No. 8,709,309 entitled "Devices and Methods for the Production of Coaxial Microfibers and Nanofibers" to Peno et al.; all of which are incorporated herein by reference.

In some embodiments, a fiber producing device may include a body. The body may be formed such that a portion of the body may function to facilitate conveyance of produced fibers away from the body. For example, the body of a fiber producing device may include draft members which create a gas flow proximate to the fiber producing device. In some embodiments, a fiber producing device may include two or more draft members. In some embodiments, a fiber producing device may include four draft members. Draft members may function as blades on a fan creating a gas current. The gas current created by the draft members may facilitate movement of the produced fibers away from the fiber producing device. The gas currents may direct the produced fibers in a fiber producing system. In some embodiments, draft members may be angled out of the plane of the body of the fiber producing device. Draft members may be angled, much like blades of a fan, increasing the strength of a gas current produced by the draft members. In some embodiments, an angle of the draft members may be adjusted by a user in order to increase/decrease a strength of the gas current produced during use. Upon adjustment the draft members may be locked into place.

Figure 1B:
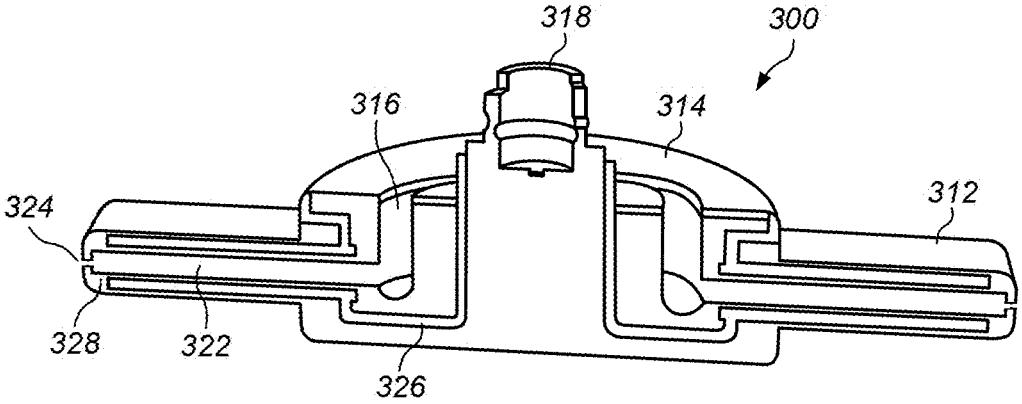
FIG. 1B depicts a cross section of an embodiment of a body of a fiber producing device with four external draft members.

FIGS. 1A-B depict an embodiment of a fiber producing device 300 with draft members 312 positioned outside of a ring portion 314 of the body of the fiber producing device Channel 316 may function as a material input channel, wherein material is positioned in the channel before being spun out of openings in members 312 and produced into fibers. As depicted in the cross section of FIG. 3B, draft members 312 may include a channel 322. Channels 322 may function to connect openings 324 with channel 316 to produce fibers during use. In some embodiments, the body may be formed from layers of insulating material 326 and heat transmitting material 328. Coupling member 318 may function to couple fiber producing device 300 to a drive system of a fiber producing system. In some embodiments, a top surface of exterior ring portion 314 may be compatible with an inductive heating system.

Figure 2:
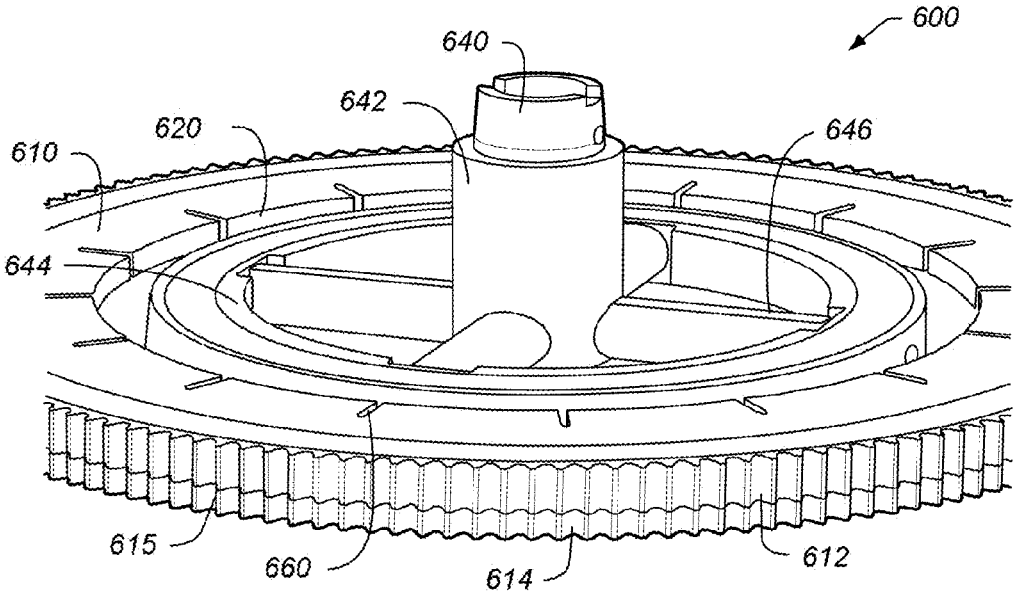
FIG. 2 depicts an alternate version of a gear fiber producing device.

FIG. 2 depicts a projection view of another embodiment of a fiber producing device. Fiber producing device 600 includes a gear like body 610, having a plurality of orifices 615 disposed on the tip of the "tooth" of each gear like extension. Body 610 may be composed of a top member 612 and a bottom member 614. Top member 612 and bottom member 614 together define a body cavity (not shown), in which the material to be formed into fibers is disposed. An opening 620 extends through top member 612 to the body cavity to allow material to be placed into body cavity. Use of a channel that couples directly to the body cavity allows introduction of the material from the top face of the body while the body is being rotated. Fiber producing device 600 is coupled to a drive using coupling member 640. Coupling member, in some embodiments, has an open hub design. An open hub design features a central coupler 642 which is connected to a coupling ring 644 through one or more arms 646, leaving a substantially empty area between the central coupler and the coupling ring. This open hub design helps improve air flow management around the fiber producing device.

Fiber producing devices may be heated by induction, as described herein. Induction produces currents in the body of the fiber producing device which heats the device. It is often desirable to control the location of the heating by steering the induced currents to the regions where heat is desired. In FIG. 2, a fiber producing device has radial slots 660 cut in the upper plate to push induced circumferential currents to the outer diameters of the device.

In a fiber producing system where the fibers are laid down on a substrate perpendicular to the axis of rotation, below the fiber producing device, it is important that the spread of the fibers be controlled such that the deposited fibers are as uniform as possible across the deposition width. Several system parameters influence, and can be altered, to control the spread of fibers. For example, rotational velocity, chamber air flow, and distance between the fiber producing device and the substrate are among the system parameters that may be easily modified.

An additional parameter that may be used to modify the spread of fibers is the air flow at the openings of the fiber producing device. One way to control the air flow at the openings of a fiber producing device is to alter the shape of the body. It has been found that the body of a fiber producing device can be shaped in a way such that the air flow between the top surface and the bottom surface of the body creates different velocities in the vicinity of the openings. Thus the fiber trajectory may be controlled by changing the shape of the body. Generally, the shape of the sides of the body have the most effect on the airflow around the openings. For example, varying the diameter between the top surface and the bottom surface of the body of a fiber producing device can create different air flows proximate to the openings.

Figure 3A:
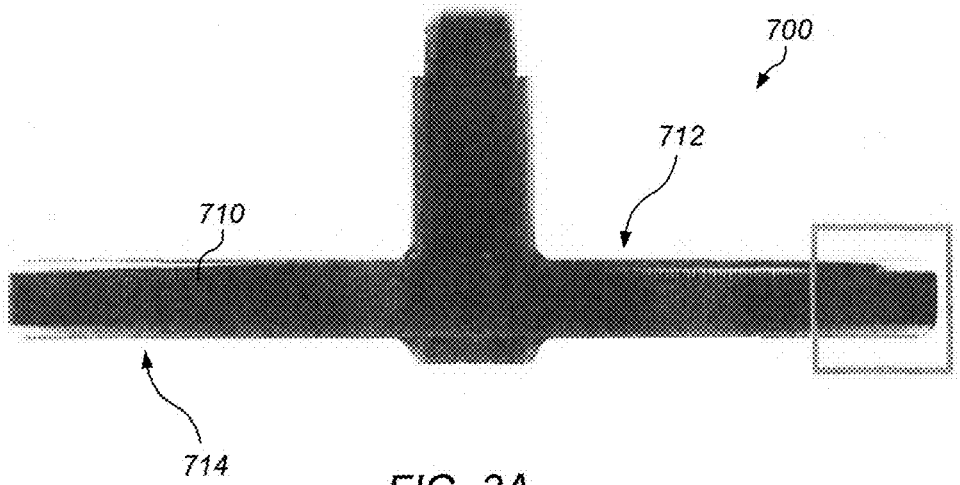
FIG. 3A depicts a fiber producing device having a diameter that varies between a top surface and a bottom surface of the body and includes multiple rows of orifices.
Figure 3B:
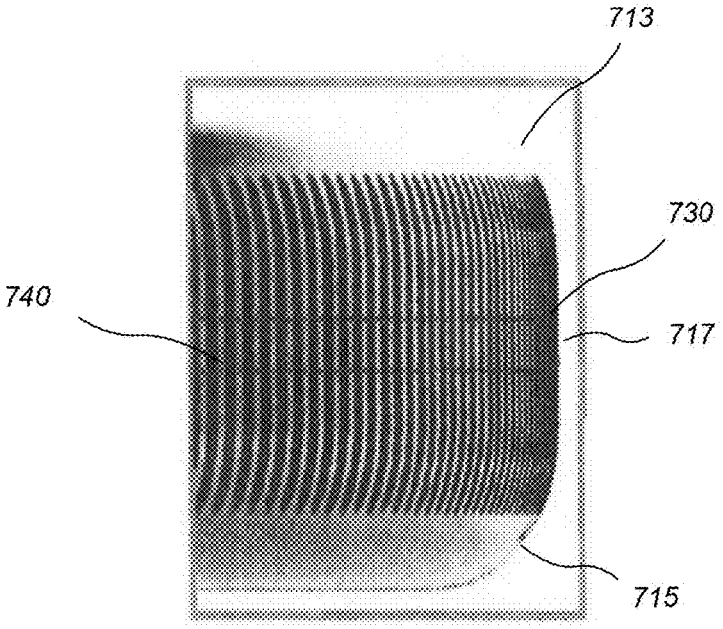
FIG. 3B depicts a close-up or a portion of the body denoted by the box in FIG. 3A.

FIGS. 3A-B depict an embodiment of a fiber producing device 700. Fiber producing device 700 includes a substantially circular body 710 having an internal cavity. One or more openings 730 are formed in the sidewalls of the fiber producing device communicating with the internal cavity. Openings 730 may include two rows of openings arranged as two substantially parallel lines of openings. Both lines are spaced an equal distance from center 717 of body 710. A coupling member 720 is coupled to the body. The coupling member is used to couple body 710 to a driver.

In one embodiment, the diameter of the body varies between a top surface 712 and a bottom surface 714. In this embodiment, the body has a symmetrical profile. For example, body 710 has a rounded top portion 713 and a rounded bottom portion 715. Thus body 710 has a diameter at top portion 713 that is less than the diameter at center 717 of the body and a diameter at bottom portion 715 that is less than the diameter at center 717 of the body. The reduced diameter of the top and bottom portions of body 710 creates a predefined airflow in a region proximate to the openings. The predefined airflow enhances the movement of the fibers away from the fiber producing device in a manner that will help ensure a mote even distribution of the fibers when deposited on a substrate. The profile of fiber producing device 700 is such that central portion 717 of body 710 is substantially vertical, and lies in a line parallel with the axis of rotation. The portion of body 710 proximate to the top portion and the bottom portion may be substantially rounded to create the varying diameter for the body. Body 710 further includes a plurality of vertical grooves 740, formed in the sidewalls, the vertical grooves enhance the flow of air around the openings 730.

Figure 4A:
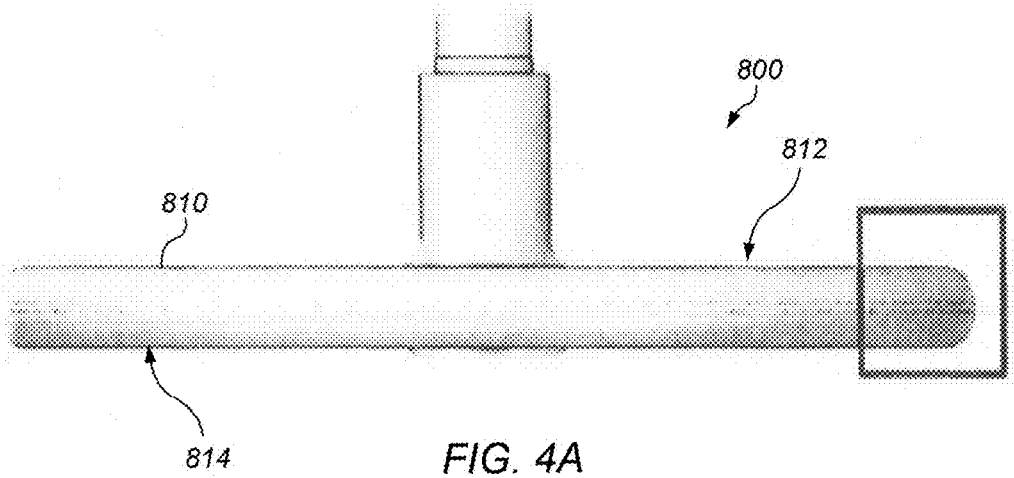
FIG. 4A depicts a fiber producing device having a rounded profile having multiple rows of orifices.
Figure 4B:
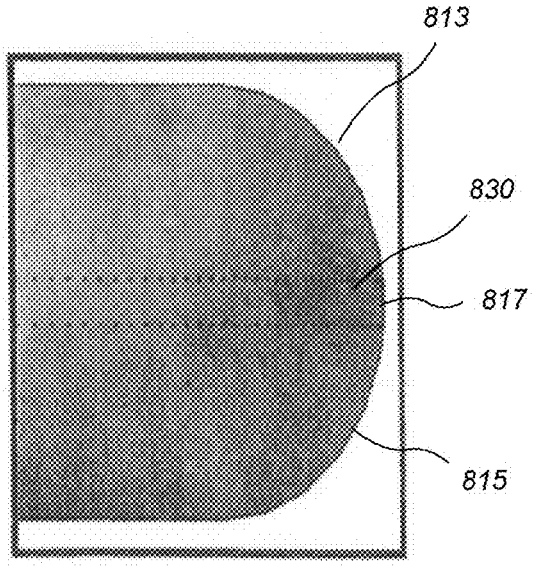
FIG. 4B depicts a close-up or a portion of the body denoted by the box in FIG. 4A.

FIGS. 4A-B depict an embodiment of a fiber producing device 800. Fiber producing device 800 includes a substantially circular body 810 having an internal cavity. One or more openings 830 are formed in the sidewalls of the fiber producing device communicating with the internal cavity. Openings 830 may include two rows of openings arranged as two substantially parallel lines of openings. Both lines are spaced an equal distance from center 817 of body 810. A coupling member 820 is coupled to the body. The coupling member is used to couple body 810 to a driver.

In one embodiment, the diameter of the body varies between a top surface 812 and a bottom surface 814. In this embodiment, the body has a symmetrical profile. For example, body 810 has a rounded top portion 813 and a rounded bottom portion 815. Thus body 810 has a diameter at top portion 813 that is less than the diameter at center 817 of the body and a diameter at bottom portion 815 that is less than the diameter at center 817 of the body. The reduced diameter of the top and bottom portions of body 810 creates a predefined airflow in a region proximate to the openings. The predefined airflow enhances the movement of the fibers away from the fiber producing device in a manner that will help ensure a mote even distribution of the fibers when deposited on a substrate. The profile of fiber producing device 800 is substantially rounded from center 817 to top surface 812 and from the center to the bottom surface 814 to create the varying diameter for the body.

Figure 5A:
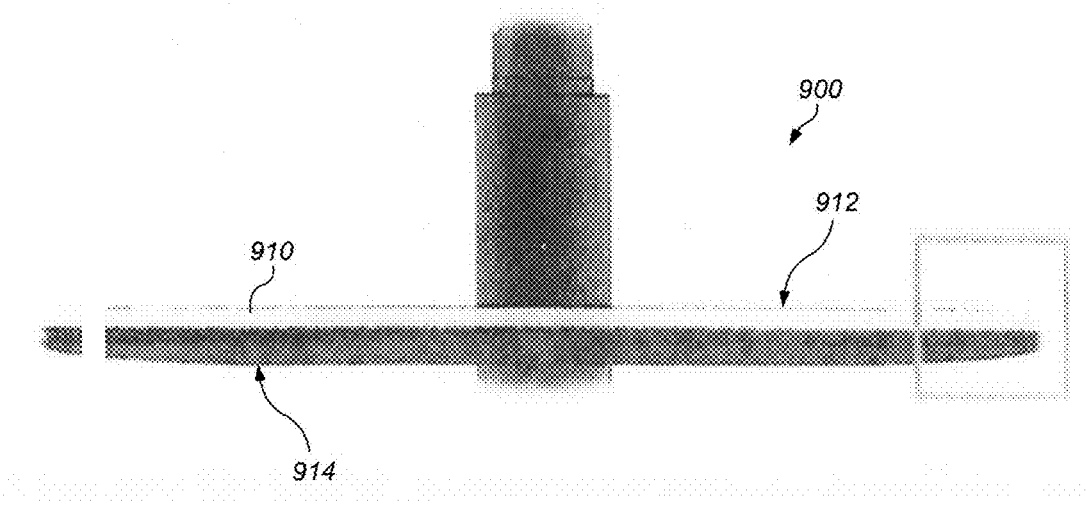
FIG. 5A depicts a fiber producing device having an asymmetric profile.
Figure 5B:
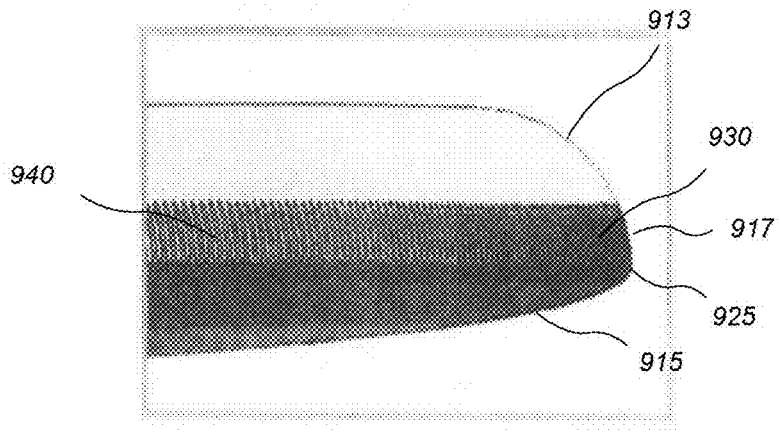
FIG. 5B depicts a close-up or a portion of the body denoted by the box in FIG. 5A.

FIGS. 5A-B depict an embodiment of a fiber producing device 900. Fiber producing device 900 includes a substantially circular body 910 having an internal cavity. One or more openings 930 are formed in the sidewalls of the fiber producing device communicating with the internal cavity. Openings 930 may include a single row of openings or two rows of openings arranged as two substantially parallel lines of openings. When two lines of openings are present, both lines are spaced an equal distance from center 917 of body 910. A coupling member 920 is coupled to the body. The coupling member is used to couple body 910 to a driver. It should be understood that two lines of openings is merely illustrative, the number of lines of openings may be two or more.

In one embodiment, the diameter of the body varies between a top surface 912 and a bottom surface 914. In this embodiment, the body has an asymmetrical profile. Body 910 has a rounded top portion 913 and a rounded bottom portion 915. Thus body 910 has a diameter at top portion 913 that is less than the diameter at center 917 of the body and a diameter at bottom portion 915 that is less than the diameter at center 917 of the body. The reduced diameter of the top and bottom portions of body 910 creates a predefined airflow in a region proximate to the openings. The predefined airflow enhances the movement of the fibers away from the fiber producing device in a manner that will help ensure a more even distribution of the fibers when deposited on a substrate. The profile of fiber producing device 900 is asymmetrical. Thus the top portion is substantially rounded from an off center position 925 to top surface 912 and from the off center position 925 to the bottom surface 914 to create an asymmetrical profile. Body 910 further includes a plurality of vertical grooves 940, formed in the sidewalls, the vertical grooves enhance the flow of air around the openings 930.

In an embodiment of a fiber producing system, a heating device may be positioned substantially inside a body of a fiber producing device. An embodiment of a fiber producing system is depicted in FIGS. 6A-D. Fiber producing system 1200 includes a fiber producing device 1210. Fiber producing device 1210 includes a body 1212 and a coupling member 1214. Body 1212 comprises one or more openings 1216 through which material disposed in the body may pass through during use. As discussed previously, interior cavity of the body may include angled or rounded walls to help direct material disposed in body 1212 toward openings 1216. In some embodiments, an interior cavity of body 1212 may have few or no angled or rounded walls to help direct material disposed in body 1212 because such angled walls are not necessary due to the material and/or the speed at which the body is spinning during the process. Coupling member 1214 may be an elongated member extending from the body which may be coupled to a driver 1218. Alternatively, coupling member may be a receiver which will accept an elongated member from a driver (e.g., the coupling member may be a chuck or a universal threaded joint).

Figure 6A:
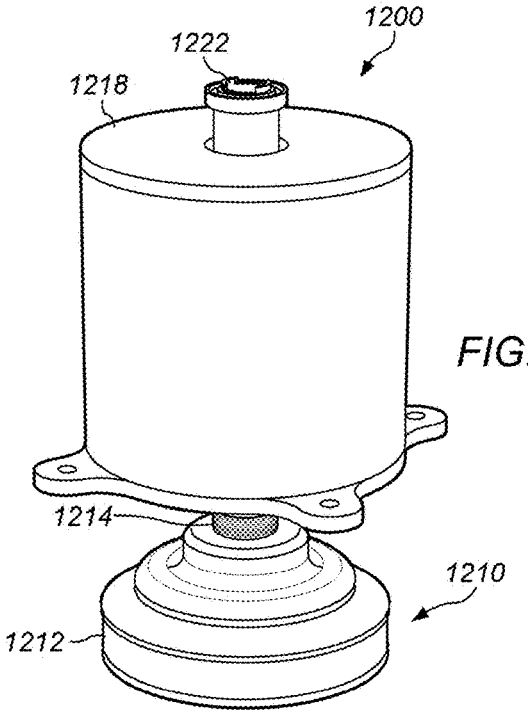
FIG. 6A depicts an embodiment of a fiber producing system with a driver mounted above the fiber producing device.
Figure 6B:
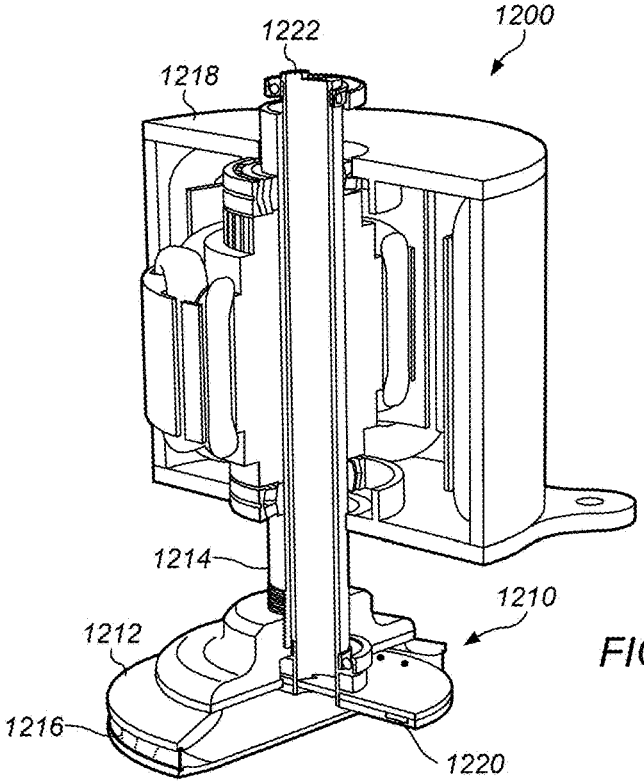
FIG. 6B depicts an embodiment of a cross section of a fiber producing system with a driver mounted above the fiber producing device.
Figure 6C:
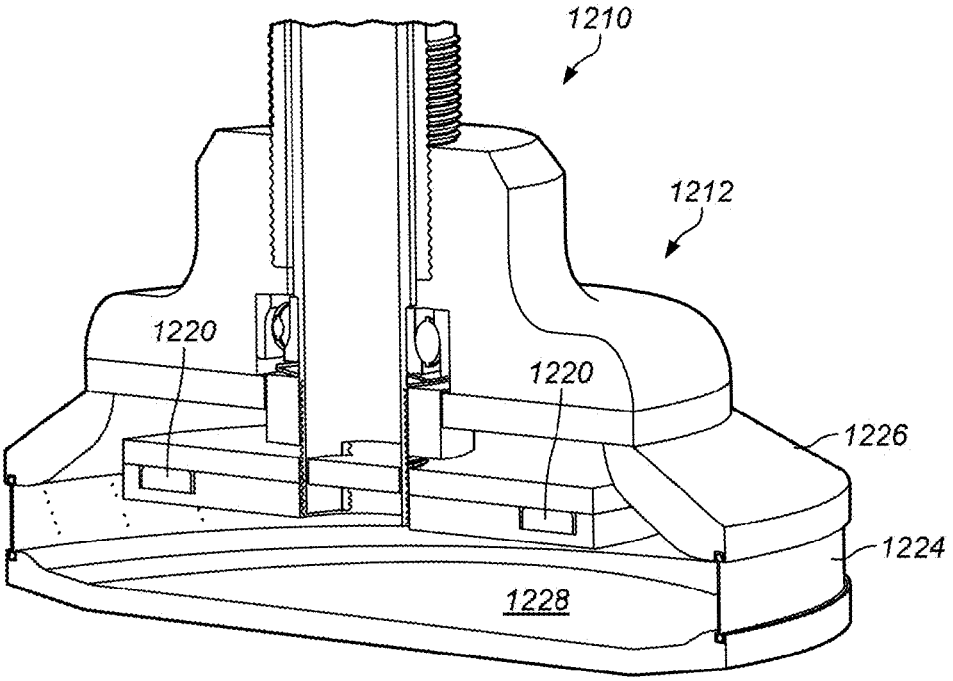
FIG. 6C depicts an embodiment of a cross section of a body of a fiber producing system.

In some embodiment, fiber producing device 1210 may include internal heating device 1220 (e.g., depicted in FIGS. 6B-C). Heating device 1220 may function to heat material conveyed into body 1212 facilitating the production of fibers as the material is conveyed through one or more openings 1216. Heating device 1220 may heat material inductively or radiantly. In some embodiments, a heating device may heat material conductively, inductively or radiantly. In some embodiments, a heating device may heat material using RF, lasers, or infrared.

In some embodiments, heating device 1220 may move during use. Heating device 1220 may move in coordination with body 1212 during use. Heating device 1220 may be coupled to coupling member 1214.

In some embodiments, heating device 1220 may remain substantially motionless in relation to body 1212 during use such that as body 1212 spins, heating device 1220 remains relatively motionless. In some embodiments, heating device 1220 may be coupled to elongated conduit 1222. Elongated conduit 1222 may be at least partially positioned in coupling member 1224. Elongated conduit 1222 may move independently of coupling member 1224 such that as the coupling member rotates body 1212 rotates without moving elongated conduit 1222. In some embodiments, elongated conduit 1222 may supply power to heating device 1220.

In some embodiments, materials used to form fibers may be conveyed into a body of a fiber producing device. In some embodiments, the material may be conveyed to the body under pressure. Pressurized feed of materials into a fiber producing device may facilitate fiber production by forcing the materials through the openings in addition to the force provided by the spinning body of the device. A pressurized feed system may allow for produced fibers to be ejected from the openings at a higher velocity. A pressurized feed system may also allow for cleaning the fiber producing device by conveying gasses and/or solvents under pressure through the device to facilitate cleaning. In some embodiments, elongated conduit 1222 may function to convey materials to body 1212. Elongated conduit 1222 may in some embodiments convey materials through driver 1218 (e.g., as depicted in FIG. 6B). Conveying materials through the elongated conduit may allow for the material to be delivered in an atmosphere other than air/oxygen. Materials may be conveyed using an inert atmosphere such as argon or nitrogen.

In some embodiments, a driver may include a direct drive coupled to a body of a fiber producing device. A direct drive system may increase the efficiency of the fiber producing system. Direct drive mechanisms are typically devices that take the power coming from a motor without any reductions (e.g., a gearbox). In addition to increased efficiency a direct drive has other advantages including reduced noise, longer lifetime, and providing high torque a low rpm. Elongated conduit 1222 may in some embodiments convey materials through driver 1218 (e.g., as depicted in FIG. 6B), in some embodiments driver 1218 may include a direct driver.

Figure 6D:
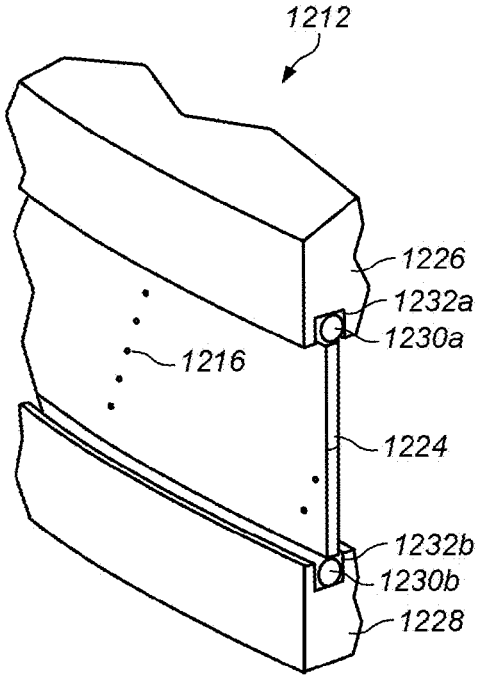
FIG. 6D depicts an embodiment of a cross section of a body of a portion of a sidewall, top member, and bottom member of a fiber producing system.

FIG. 6D depicts an embodiment of a cross section of a body 1212 of a portion of a sidewall 1224, top member 1226, and bottom member 1228 of a fiber producing system.

Fiber producing system 1200 includes a fiber producing device 1210. Fiber producing device 1210 includes a body 1212 and a coupling member 1214. Body 1212 comprises one or more openings 1216 through which material disposed in the body may pass through during use. Sidewall 1224 may include a plurality of openings 1216. In some embodiments, the plurality of openings may include a patterned array of openings. The patterned array may include a repeating pattern. The pattern may be such that no opening in the pattern is aligned vertically with another opening. The pattern may be such as to include a minimum distance between openings horizontally. In some embodiments, a pattern may inhibit entwining of fibers. Inhibition of fiber entwining or "roping" may result in a more consistent fiber product and better product.

Different patterns of openings may be desired and/or one or more openings may become clogged during normal use. In some embodiments, sidewall 1224 of body 1212 may be replaced without having to replace any other components of a fiber producing device. Sidewall 1224 may be couplable to top member 1226, and bottom member 1228 of a fiber producing system. Edges 1230*a* and 1230*b* of a sidewall may fit within channels 1232*a* and 1232*b* of top member 1226 and bottom member 1228 respectively. Edges 1230 may function to couple sidewall 1224 to top member 1226 and bottom member 1228. In some embodiments, the edges of the sidewall may form a friction fit with the channels of the top and bottom members. In some embodiments, the edges of the sidewall may have a cross section similar to a cross section of the channels of the top and bottom members such that the edges may slide into the channels in a lateral direction but inhibited from being pulled out of the channels in any other direction.

In an embodiment, a heating device used to heat a fiber producing device is a radiant heater. An infrared heater is an example of a radiant heater that may be used to heat a fiber producing device. In some embodiments, a heating device may include an infrared heating device. An infrared heating device may include a device which is tuned or tuneable to a specific infrared wavelength. An infrared wavelength may be chosen based upon what type of material is being heated.

Infrared radiant heating is used extensively in industry, particularly for drying of materials or fusing of coatings (e.g., powder coating, drying of paints or printed layers). Infrared heating has advantages over other forms of heating, in that the emitted radiation (if appropriately specified) is only absorbed by the substrate (or treated potions of the substrate) and not by the surrounding air or objects. Infrared heating may be defined as applying radiant energy to the part surface by direct transmission from an emitter (source). Some of the energy emitted may be reflected off the surface, some may be absorbed by the substrate and some may be transmitted though the substrate. The absorption characteristics may depend on the type of material, the colour, and the surface finish. For example, a rough, black object will absorb more infrared energy than will a smooth white object which reflects more energy. The actual behavior of infrared energy depends on the wavelength, the distance between the substrate and the emitter, the mass of the part, the surface area and the color sensitivity. Generally shorter wavelength infrared radiation penetrates further into the substrate but is more sensitive to changes in the color of the substrate. Generally speaking, polymers absorb more effectively in the medium infrared range.

When radiation is applied to a polymer surface it can be reflected, transmitted, or absorbed. It is the absorbed portion that leads to temperature increase and consequently leads to melting of the polymer. The amount of radiation absorbed by a pure unfilled thermoplastic is determined by the vibrations of its atoms. For a vibration to be infrared-active, it must be associated with a change in dipole moment which can be activated by the oscillating electric field of incident infrared radiation. Certain vibrational modes have frequencies within the infrared spectrum and can therefore absorb infrared radiation of specific wavelengths. Plastic materials absorb infrared radiation at wavelengths from about 2 to about 15 μm. Wavelengths of 3.3 to 3.5 μm correspond to vibrational modes of C—H bonds; alcohol, carboxylic acid, or amide groups absorb infrared energy at wavelengths of about 2 to about 3 μm. Absorption of infrared radiation induces molecular vibrations (e.g., stretching, rocking, etc.) which increase the temperature of the organic polymer. Infrared heating device therefore may have several advantages including restricting heating energy to the desired material. In this way less energy is wasted during the heating process because it is directed towards a specific material.

In some embodiments, a heating device (e.g., an infrared heating device) may be positioned to heat materials before and/or as they enter the body of a fiber producing device. In some embodiments, an infrared heating device may be positioned at least partially in the interior of a fiber producing device. In such embodiments, an infrared heating device may heat material conveyed through a body of the fiber producing device. The infrared heating device may function to heat the material such that the material melts such that when the body spins the material passes through openings in the body to produce fibers. The infrared heating device may further heat material in the body which was previously melted prior to introduction into the body. The infrared heating device may further heat material in the body which was previously melted prior to introduction into the body. Further heating material may function to decrease the viscosity of the material. Further heating material may function to decrease the viscosity of the material such that flowing of the material through the openings is facilitated.

In some embodiments, an infrared heating system may be used to heat at least a portion of the environment substantially adjacent to a body of the fiber producing device. Specifically the infrared heating system may be used to heat at least a portion of the environment substantially adjacent to a plurality of openings in the body through which the material is conveyed in order to produce the fibers. Heating the environment around the body of the fiber producing device may allow for longer fibers to be produced by extending the quench rate of fibers exiting the openings in the body of the fiber producing device. By adjusting the infrared heating device one may adjust a length of the fibers produced by the fiber producing device.

Figure 7:
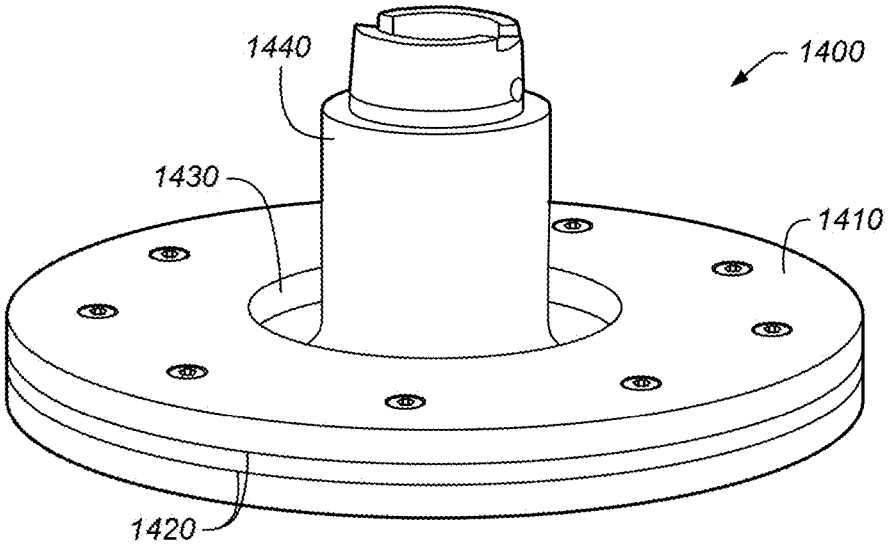
FIG. 7 depicts an alternate embodiment of a fiber producing device.
Figure 8:
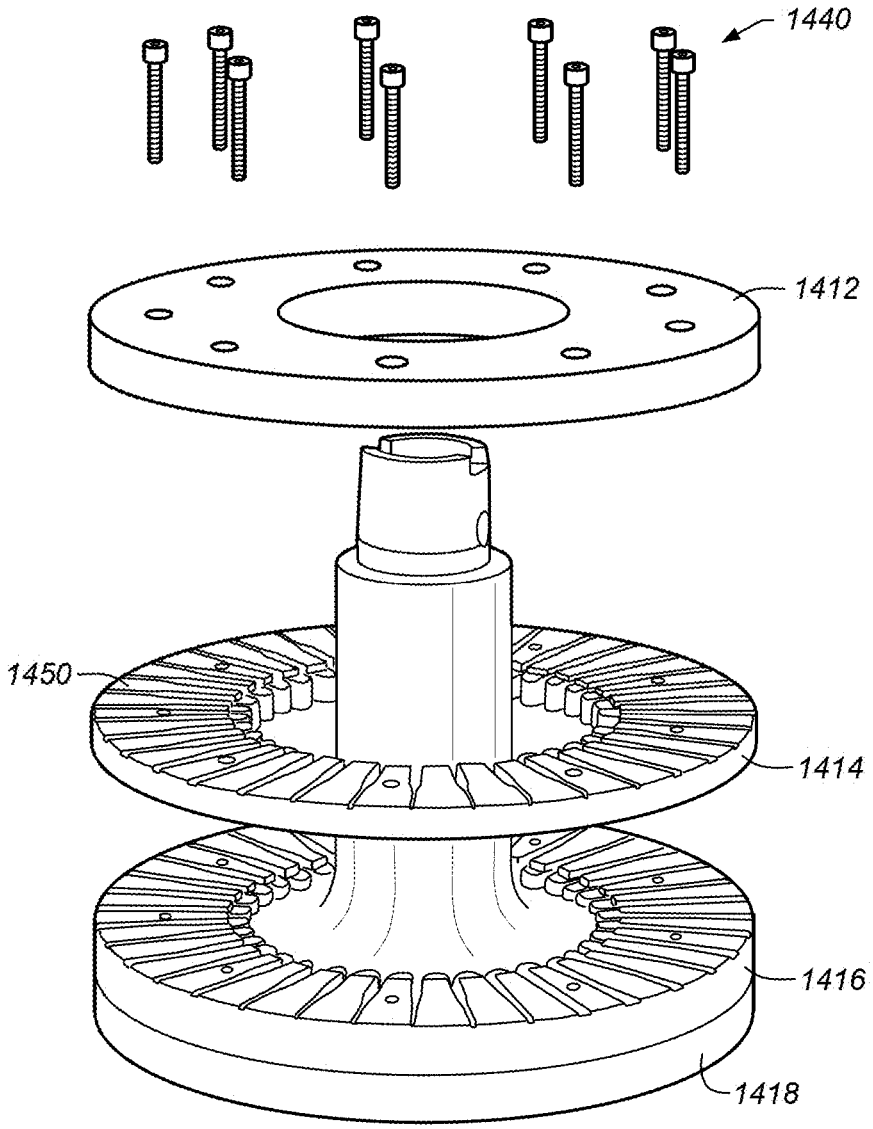
FIG. 8 depicts an exploded view of the fiber producing device of FIG. 7.

FIGS. 7 and 8 depict an alternate embodiment of a fiber producing device. Fiber producing device 1400 includes a body 1410, having a plurality of orifices disposed in slot 1420. Body 1410 may be composed of two or more members. In the embodiment depicted a grooved member 1414 is placed on grooved support 1418. Support 1418 provides a base upon which the grooved members may be stacked. Support 1418 also includes a coupling member 1430 which may be used to couple fiber producing device 1400 to a driver. While two grooved members are depicted, it should be understood that more or less grooved members may be used.

In one embodiment, fiber producing device 1400 includes a top member 1412 and a support member 1418 with one or more grooved members (1414, 1416) sandwiched between the top member and the support member. To assemble fiber producing device 1400, a first grooved member 1416 is placed on support 1418. A seal (not shown) may be disposed between grooved member 1416 and support 1418. A second grooved member 1414 is placed on first grooved member 1416. A seal (not shown) may be disposed between second grooved member 1414 and first grooved member 1416. When coupled together first grooved member 1416 and second grooved member 1414 define slot 1420, which runs around the circumference of the fiber producing device. Top member 1412 is placed on second grooved member 1414 and is fastened to support member 1418 by fasteners 1440, which extend through the top member, first, and second groove members into the support member. A seal (not shown) may be disposed between top member 1412 and second grooved member 1414. When coupled together top member 1412 and second grooved member 1414 define a slot 1420, which runs around the circumference of the fiber producing device.

When fiber producing device 1400 is assembled, a body cavity 1430 is defined by support member 1418, grooved members 1416 and 1414, and top member 1412. Material may be placed into body cavity 1460 during use. A plurality of grooves 1450 are formed in grooved members 1414 and 1416. When fiber producing device 1400 is rotated, material disposed in body cavity 1460 enters grooves 1450, which transports the material through the fiber producing device to be ejected through openings at slot 1420.

Figure 9:
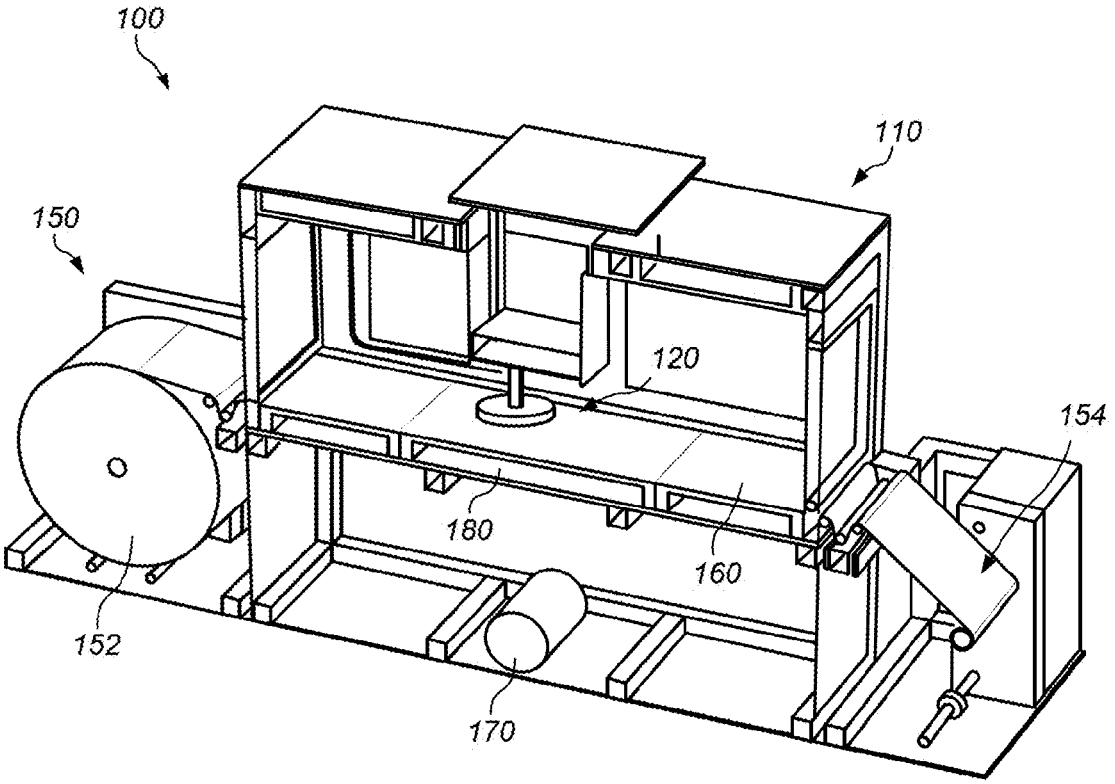
FIG. 9 depicts a fiber deposition system.

An embodiment of a system 100 for depositing fibers onto a substrate is depicted in FIG. 9. System 100 includes a fiber producing system 110 and a substrate transfer system 150. Fiber producing system 110 includes a fiber producing device 120, as described herein. Fiber producing system produces and directs fibers produced by a fiber producing device toward a substrate 160 disposed below the fiber producing device during use. Substrate transfer system moves a continuous sheet of substrate material through the deposition system.

Figure 10:
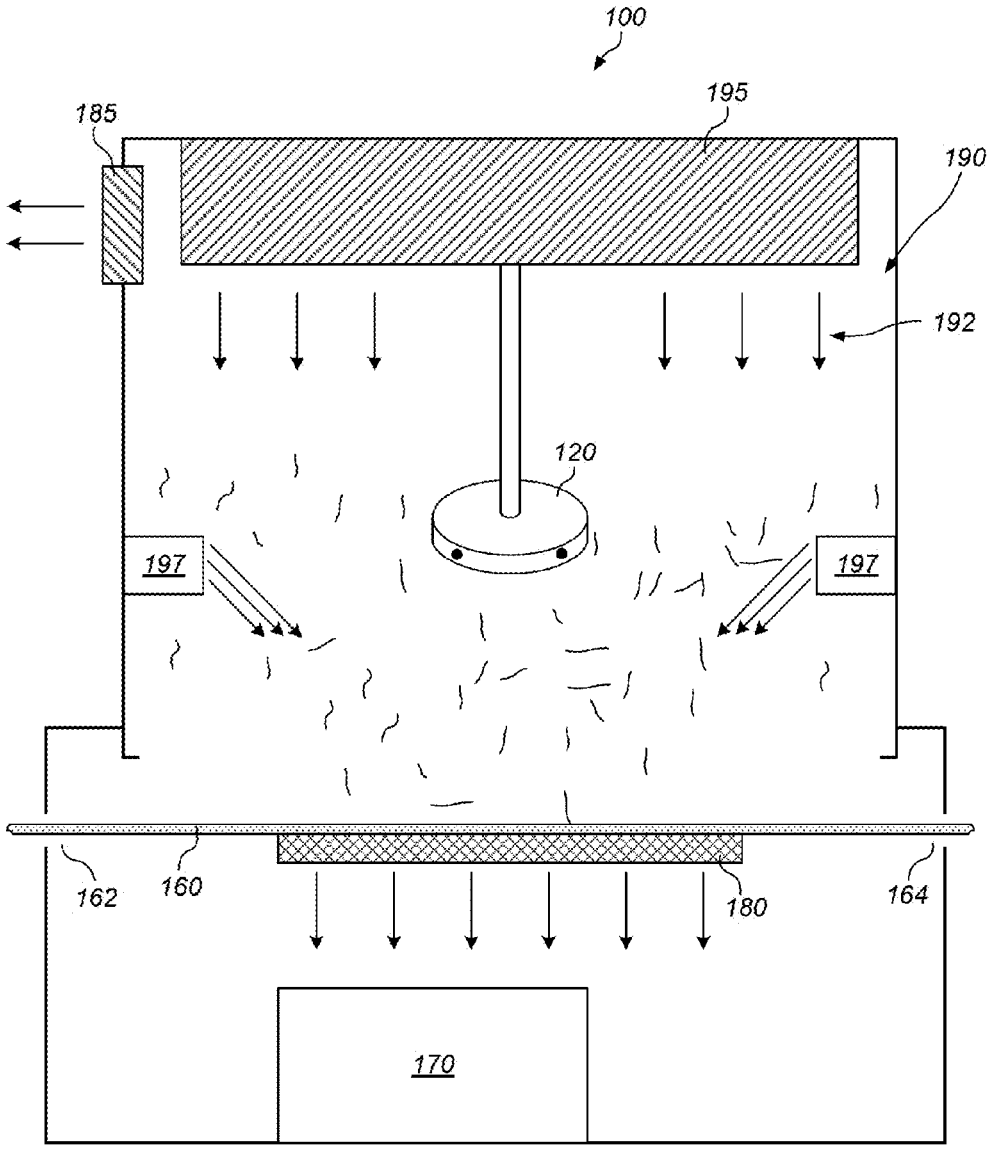
FIG. 10 depicts a schematic diagram of a fiber deposition system in use.
Figure 11A:
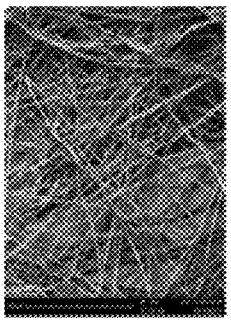
FIGS. 11A-G depict photographs of the fibers produced under various experimental conditions.
Figure 11B:
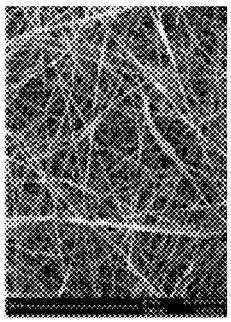
Figure 11C:
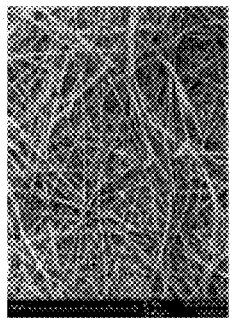
Figure 11D:
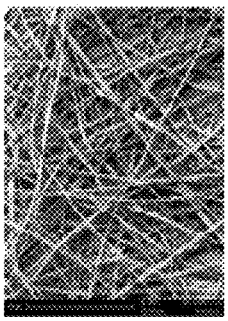
Figure 11E:
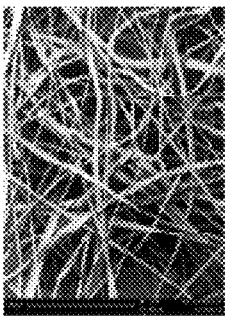
Figure 11F:
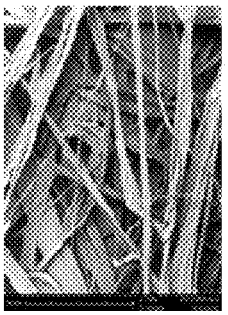
Figure 11G:
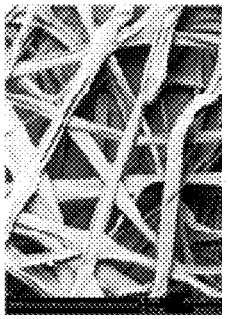

System 100, in one embodiment, includes a top mounted fiber producing device 120. During use, fibers produced by fiber producing device 120 are deposited onto substrate 160. A schematic diagram of system 100 is depicted in FIG. 10. Fiber producing system 110 may include one or more of: a vacuum system 170, an electrostatic plate 180, and a gas flow system 190. A vacuum system produces a region of reduced pressure under substrate 160 such that fibers produced by fiber producing device 110 are drawn toward the substrate due to the reduced pressure. Alternatively, one or more fans may be positioned under the substrate to create an air flow through the substrate. Gas flow system 190 produces a gas flow 192 that directs fibers formed by the fiber producing device toward the substrate. Gas flow system may be a pressurized air source or one or more fans that produce a flow of air (or other gases). The combination of vacuum and air flow systems are used to produce a "balanced air flow" from the top of the deposition chamber through the substrate to the exhaust system by using forced air (fans, pressurized air) and exhaust air (fans, to create an outward flow) and balancing and directing the airflow to produce a fiber deposition field down to the substrate. System 100 includes substrate inlet 162 and substrate outlet 164.

An electrostatic plate 180 is also positioned below substrate 160. The electrostatic plate is a plate capable of being charged to a predetermined polarity. Typically, fibers produced by the fiber producing device have a net charge. The net charge of the fibers may be positive or negative, depending on the type of material used. To improve deposition of charged fibers, electrostatic plate 180 may be disposed below substrate 160 and be charged to an opposite polarity as the produced fibers. In this manner, the fibers are attracted to the electrostatic plate due to the electrostatic attraction between the opposite charges. The fibers become embedded in the substrate as the fibers move toward the electrostatic plate.

A pressurized gas producing and distribution system may be used to control the flow of fibers toward a substrate disposed below the fiber producing device. During use fibers produced by the fiber producing device are dispersed within the deposition system. Since the fibers are composed primarily of microfibers and/or nanofibers, the fibers tend to disperse within the deposition system. The use of a pressurized gas producing and distribution system may help guide the fibers toward the substrate. In one embodiment, a gas flow system 190 includes a downward gas flow device 195 and a lateral gas flow device 197. Downward gas flow device 195 is positioned above or even with the fiber producing device to facilitate even fiber movement toward the substrate. One or more lateral gas flow devices 197 are oriented perpendicular to or below the fiber producing device. In some embodiment, lateral gas flow devices 197 have an outlet width equal to the substrate width to facilitate even fiber deposition onto substrate. In some embodiments, the angle of the outlet of one or more lateral gas flow devices 197 may be varied to allow better control of the fiber deposition onto the substrate. Each lateral gas flow devices 197 may be independently operated.

During use of the deposition system, fiber producing device 120 may produce various gasses due to evaporation of solvents (during solution spinning) and material gasification (during melt spinning). Such gasses, if accumulated in the deposition system may begin to affect the quality of the fiber produced. In some embodiment, the deposition system includes an outlet fan 185 to remove gasses produced during fiber production from the deposition system.

Substrate transfer system 150, in one embodiment depicted in FIG. 9, is capable of moving a continuous sheet of substrate material through the deposition system. In one embodiment, substrate transfer system 150 includes a substrate reel 152 and a take up reel system 154. During use, a roll of substrate material is placed on substrate reel 152 and threaded through system 100 to the substrate take up reel system 154. During use, substrate take up reel system 154 rotates, pulling substrate through deposition system at a predetermined rate. In this manner, a continuous roll of a substrate material may be pulled through fiber deposition system.

Further embodiments of deposition systems are described in U.S. Published Patent Application No. 2014/0159262, which is incorporated herein by reference.

Fibers represent a class of materials that are continuous filaments or that are in discrete elongated pieces, similar to lengths of thread. Fibers are of great importance in the biology of both plants and animals, e.g., for holding tissues together. Human uses for fibers are diverse. For example, fibers may be spun into filaments, thread, string, or rope. Fibers may also be used as a component of composite materials. Fibers may also be matted into sheets to make products such as paper or felt. Fibers are often used in the manufacture of other materials.

Fibers as discussed herein may be created using, for example, a solution spinning method or a melt spinning method. In both the melt and solution spinning methods, a material may be put into a fiber producing device which is spun at various speeds until fibers of appropriate dimensions are made. The material may be formed, for example, by melting a solute or may be a solution formed by dissolving a mixture of a solute and a solvent. Any solution or melt familiar to those of ordinary skill in the art may be employed. For solution spinning, a material may be designed to achieve a desired viscosity, or a surfactant may be added to improve flow, or a plasticizer may be added to soften a rigid fiber. In melt spinning, solid particles may comprise, for example, a metal, ceramic, or a polymer, wherein polymer additives may be combined with the latter. Certain materials may be added for alloying purposes (e.g., metals) or adding value (such as antioxidant or colorant properties) to the desired fibers.

Non-limiting examples of reagents that may be melted, or dissolved or combined with a solvent to form a material for melt or solution spinning methods include polyolefin, polyacetal, polyamide, polyester, cellulose ether and ester (e.g., cellulose acetate, cellulose diacetate, cellulose triacetate, etc.), polyalkylene sulfide, polyarylene oxide, polysulfone, modified polysulfone polymers and mixtures thereof. Non-limiting examples of solvents that may be used include oils, lipids and organic solvents such as DMSO, toluene, low boiling organic acids (e.g., formic acid, acetic acid, etc.) and alcohols. Water, such as de-ionized water, may also be used as a solvent. For safety purposes, non-flammable solvents are preferred.

In either the solution or melt spinning method, as the material is ejected from the spinning fiber producing device, thin jets of the material are simultaneously stretched and dried or stretched and cooled in the surrounding environment. Interactions between the material and the environment at a high strain rate (due to stretching) leads to solidification of the material into fibers, which may be accompanied by evaporation of solvent. By manipulating the temperature and strain rate, the viscosity of the material may be controlled to manipulate the size and morphology of the fibers that are created. A wide variety of fibers may be created using the present methods, including novel fibers such as polypropylene (PP) nanofibers. Non-limiting examples of fibers made using the melt spinning method include polypropylene, acrylonitrile butadiene styrene (ABS) and nylon. Non-limiting examples of fibers made using the solution spinning method include polyethylene oxide (PEO) and beta-lactams.

The creation of fibers may be done in batch modes or in continuous modes. In the latter case, material can fed continuously into the fiber producing device and the process can be continued over days (e.g., 1-7 days) and even weeks (e.g., 1-4 weeks).

The methods discussed herein may be used to create, for example, nanocomposites and functionally graded materials that can be used for fields as diverse as, for example, drug delivery and ultrafiltration (such as electrets). Metallic and ceramic nanofibers, for example, may be manufactured by controlling various parameters, such as material selection and temperature. At a minimum, the methods and apparatuses discussed herein may find application in any industry that utilizes micro- to nano-sized fibers and/or micro- to nano-sized composites. Such industries include, but are not limited to, material engineering, mechanical engineering, military/defense industries, biotechnology, medical devices, tissue engineering industries, food engineering, drug delivery, electrical industries, or in ultrafiltration and/or microelectric mechanical systems (MEMS).

Some embodiments of a fiber producing device may be used for melt and/or solution processes. Some embodiments of a fiber producing device may be used for making organic and/or inorganic fibers. With appropriate manipulation of the environment and process, it is possible to form fibers of various configurations, such as continuous, discontinuous, mat, random fibers, unidirectional fibers, woven and non-woven, as well as fiber shapes, such as circular, elliptical and rectangular (e.g., ribbon). Other shapes are also possible. The produced fibers may be single lumen or multi-lumen.

By controlling the process parameters, fibers can be made in micron, sub-micron and nano-sizes, and combinations thereof. In general, the fibers created will have a relatively narrow distribution of fiber diameters. Some variation in diameter and cross-sectional configuration may occur along the length of individual fibers and between fibers.

Generally speaking, a fiber producing device helps control various properties of the fibers, such as the cross-sectional shape and diameter size of the fibers. More particularly, the speed and temperature of a fiber producing device, as well as the cross-sectional shape, diameter size and angle of the outlets in a fiber producing device, all may help control the cross-sectional shape and diameter size of the fibers. Lengths of fibers produced may also be influenced by the choice of fiber producing device used.

The temperature of the fiber producing device may influence fiber properties, in certain embodiments. Both resistance and inductance heaters may be used as heat sources to heat a fiber producing device. In certain embodiments, the fiber producing device is thermally coupled to a heat source that may be used to adjust the temperature of the fiber producing device before spinning, during spinning, or both before spinning and during spinning. In some embodiments, the fiber producing device is cooled. For example, a fiber producing device may be thermally coupled to a cooling source that can be used to adjust the temperature of the fiber producing device before spinning, during spinning, or before and during spinning. Temperatures of a fiber producing device may range widely. For example, a fiber producing device may be cooled to as low as −20 C or heated to as high as 2500 C. Temperatures below and above these exemplary values are also possible. In certain embodiments, the temperature of a fiber producing device before and/or during spinning is between about 4° C. and about 400° C. The temperature of a fiber producing device may be measured by using, for example, an infrared thermometer or a thermocouple.

The speed at which a fiber producing device is spun may also influence fiber properties. The speed of the fiber producing device may be fixed while the fiber producing device is spinning, or may be adjusted while the fiber producing device is spinning. Those fiber producing devices whose speed may be adjusted may, in certain embodiments, be characterized as variable speed fiber producing devices. In the methods described herein, the fiber producing device may be spun at a speed of about 500 RPM to about 25,000 RPM, or any range derivable therein. In certain embodiments, the fiber producing device is spun at a speed of no more than about 50,000 RPM, about 45,000 RPM, about 40,000 RPM, about 35,000 RPM, about 30,000 RPM, about 25,000 RPM, about 20,000 RPM, about 15,000 RPM, about 10,000 RPM, about 5,000 RPM, or about 1,000 RPM. In certain embodiments, the fiber producing device is rotated at a rate of about 5,000 RPM to about 25,000 RPM.

In an embodiment, a method of creating fibers, such as microfibers and/or nanofibers, includes: heating a material; placing the material in a heated fiber producing device; and, after placing the heated material in the heated fiber producing device, rotating the fiber producing device to eject material to create nanofibers from the material. In some embodiments, the fibers may be microfibers and/or nanofibers. A heated fiber producing device is a structure that has a temperature that is greater than ambient temperature. "Heating a material" is defined as raising the temperature of that material to a temperature above ambient temperature. "Melting a material" is defined herein as raising the temperature of the material to a temperature greater than the melting point of the material, or, for polymeric materials, raising the temperature above the glass transition temperature for the polymeric material. In alternate embodiments, the fiber producing device is not heated. Indeed, for any embodiment that employs a fiber producing device that may be heated, the fiber producing device may be used without heating. In some embodiments, the fiber producing device is heated but the material is not heated. The material becomes heated once placed in contact with the heated fiber producing device. In some embodiments, the material is heated and the fiber producing device is not heated. The fiber producing device becomes heated once it comes into contact with the heated material.

A wide range of volumes/amounts of material may be used to produce fibers. In addition, a wide range of rotation times may also be employed. For example, in certain embodiments, at least 5 milliliters (mL) of material are positioned in a fiber producing device, and the fiber producing device is rotated for at least about 10 seconds. As discussed above, the rotation may be at a rate of about 500 RPM to about 25,000 RPM, for example. The amount of material may range from mL to liters (L), or any range derivable therein. For example, in certain embodiments, at least about 50 mL to about 100 mL of the material are positioned in the fiber producing device, and the fiber producing device is rotated at a rate of about 500 RPM to about 25,000 RPM for about 300 seconds to about 2,000 seconds. In certain embodiments, at least about 5 mL to about 100 mL of the material are positioned in the fiber producing device, and the fiber producing device is rotated at a rate of 500 RPM to about 25,000 RPM for 10-500 seconds. In certain embodiments, at least 100 mL to about 1,000 mL of material is positioned in the fiber producing device, and the fiber producing device is rotated at a rate of 500 RPM to about 25,000 RPM for about 100 seconds to about 5,000 seconds. Other combinations of amounts of material, RPMs and seconds are contemplated as well.

Typical dimensions for fiber producing devices are in the range of several inches in diameter and in height. In some embodiments, a fiber producing device has a diameter of between about 1 inch to about 60 inches, from about 2 inches to about 30 inches, or from about 5 inches to about 25 inches. The height of the fiber producing device may range from about 0.5 inch to about 10 inches, from about 2 inches to about 8 inches, or from about 3 inches to about 5 inches.

In certain embodiments, fiber producing device includes at least one opening and the material is extruded through the opening to create the nanofibers. In certain embodiments, the fiber producing device includes multiple openings and the material is extruded through the multiple openings to create the nanofibers. These openings may be of a variety of shapes (e.g., circular, elliptical, rectangular, square) and of a variety of diameter sizes (e.g., 0.01-0.80 mm). When multiple openings are employed, not every opening need be identical to another opening, but in certain embodiments, every opening is of the same configuration. Some openings may include a divider that divides the material, as the material passes through the openings. The divided material may form multi-lumen fibers.

In an embodiment, material may be positioned in a reservoir of a fiber producing device. The reservoir may, for example, be defined by a concave cavity of the heated structure. In certain embodiments, the heated structure includes one or more openings in communication with the concave cavity. The fibers are extruded through the opening while the fiber producing device is rotated about a spin axis. The one or more openings have an opening axis that is not parallel with the spin axis. The fiber producing device may include a body that includes the concave cavity and a lid positioned above the body.

Another fiber producing device variable includes the material(s) used to make the fiber producing device. Fiber producing devices may be made of a variety of materials, including metals (e.g., brass, aluminum, stainless steel) and/or polymers. The choice of material depends on, for example, the temperature the material is to be heated to, or whether sterile conditions are desired.

Any method described herein may further comprise collecting at least some of the microfibers and/or nanofibers that are created. As used herein "collecting" of fibers refers to fibers coming to rest against a fiber collection device. After the fibers are collected, the fibers may be removed from a fiber collection device by a human or robot. A variety of methods and fiber (e.g., nanofiber) collection devices may be used to collect fibers.

Regarding the fibers that are collected, in certain embodiments, at least some of the fibers that are collected are continuous, discontinuous, mat, woven, nonwoven or a mixture of these configurations. In some embodiments, the fibers are not bundled into a cone shape after their creation. In some embodiments, the fibers are not bundled into a cone shape during their creation. In particular embodiments, fibers are not shaped into a particular configuration, such as a cone figuration, using gas, such as ambient air, that is blown onto the fibers as they are created and/or after they are created.

Present method may further comprise, for example, introducing a gas through an inlet in a housing, where the housing surrounds at least the heated structure. The gas may be, for example, nitrogen, helium, argon, or oxygen. A mixture of gases may be employed, in certain embodiments.

The environment in which the fibers are created may comprise a variety of conditions. For example, any fiber discussed herein may be created in a sterile environment. As used herein, the term "sterile environment" refers to an environment where greater than 99% of living germs and/or microorganisms have been removed. In certain embodiments, "sterile environment" refers to an environment substantially free of living germs and/or microorganisms. The fiber may be created, for example, in a vacuum. For example the pressure inside a fiber producing system may be less than ambient pressure. In some embodiments, the pressure inside a fiber producing system may range from about 1 millimeters (mm) of mercury (Hg) to about 700 mm Hg. In other embodiments, the pressure inside a fiber producing system may be at or about ambient pressure. In other embodiments, the pressure inside a fiber producing system may be greater than ambient pressure. For example the pressure inside a fiber producing system may range from about 800 mm Hg to about 4 atmospheres (atm) of pressure, or any range derivable therein.

In certain embodiments, the fiber is created in an environment of 0-100% humidity, or any range derivable therein. The temperature of the environment in which the fiber is created may vary widely. In certain embodiments, the temperature of the environment in which the fiber is created can be adjusted before operation (e.g., before rotating) using a heat source and/or a cooling source. Moreover, the temperature of the environment in which the fiber is created may be adjusted during operation using a heat source and/or a cooling source. The temperature of the environment may be set at sub-freezing temperatures, such as −20° C., or lower. The temperature of the environment may be as high as, for example, 2500° C.

The material employed may include one or more components. The material may be of a single phase (e.g., solid or liquid) or a mixture of phases (e.g., solid particles in a liquid). In some embodiments, the material includes a solid and the material is heated. The material may become a liquid upon heating. In another embodiment, the material may be mixed with a solvent. As used herein a "solvent" is a liquid that at least partially dissolves the material. Examples of solvents include, but are not limited to, water and organic solvents. Examples of organic solvents include, but are not limited to: hexanes, ether, ethyl acetate, formic acid, acetone, dichloromethane, chloroform, toluene, xylenes, petroleum ether, dimethylsulfoxide, dimethylformamide, or mixtures thereof. Additives may also be present. Examples of additives include, but are not limited to: thinners, surfactants, plasticizers, or combinations thereof.

The material used to form the fibers may include at least one polymer. Polymers that may be used include conjugated polymers, biopolymers, water soluble polymers, and particle infused polymers. Examples of polymers that may be used include, but are not limited to polypropylenes, polyethylenes, polyolefins, polystyrenes, polyesters, fluorinated polymers (fluoropolymers), polyamides, polyaramids, acrylonitrile butadiene styrene, nylons, polycarbonates, beta-lactams, block copolymers or any combination thereof. The polymer may be a synthetic (man-made) polymer or a natural polymer. The material used to form the fibers may be a composite of different polymers or a composite of a medicinal agent combined with a polymeric carrier. Specific polymers that may be used include, but are not limited to chitosan, nylon, nylon-6, polybutylene terephthalate (PBT), polyacrylonitrile (PAN), poly(lactic acid) (PLA), poly(lactic-co-glycolic acid) (PLGA), polyglycolic acid (PGA), polyglactin, polycaprolactone (PCL), silk, collagen, poly (methyl methacrylate) (PMMA), polydioxanone, polyphenylene sulfide (PPS); polyethylene terephthalate (PET), polytetrafluoroethylene (PTFE), polyvinylidene fluoride (PVDF), polypropylene (PP), polyethylene oxide (PEO), acrylonitrile butadiene, styrene (ABS), and polyvinylpyrrolidone (PVP). These polymers may be processed as either a melt or as a solution in a suitable solvent.

In another embodiment, the material used to form the fibers may be a metal, ceramic, or carbon-based material. Metals employed in fiber creation include, but are not limited to, bismuth, tin, zinc, silver, gold, nickel, aluminum, or combinations thereof. The material used to form the fibers may be a ceramic such as alumina, titania, silica, zirconia, or combinations thereof. The material used to form the fibers may be a composite of different metals (e.g., an alloy such as nitonol), a metal/ceramic composite or ceramic oxides (e.g., PVP with germanium/palladium/platinum).

The fibers that are created may be, for example, one micron or longer in length. For example, created fibers may be of lengths that range from about 1 μm to about 50 cm, from about 100 μm to about 10 cm, or from about 1 mm to about 1 cm. In some embodiments, the fibers may have a narrow length distribution. For example, the length of the fibers may be between about 1 μm to about 9 μm, between about 1 mm to about 9 mm, or between about 1 cm to about 9 cm. In some embodiments, when continuous methods are performed, fibers of up to about 10 meters, up to about 5 meters, or up to about 1 meter in length may be formed.

In certain embodiments, the cross-section of the fiber may be circular, elliptical or rectangular. Other shapes are also possible. The fiber may be a single-lumen fiber or a multi-lumen fiber.

In another embodiment of a method of creating a fiber, the method includes: spinning material to create the fiber; where, as the fiber is being created, the fiber is not subjected to an externally-applied electric field or an externally-applied gas; and the fiber does not fall into a liquid after being created.

Fibers discussed herein are a class of materials that exhibit an aspect ratio of at least 100 or higher. The term "microfiber" refers to fibers that have a minimum diameter in the range of 10 microns to 700 nanometers, or from 5 microns to 800 nanometers, or from 1 micron to 700 nanometers. The term "nanofiber" refers to fibers that have a minimum diameter in the range of 500 nanometers to 1 nanometer; or from 250 nanometers to 10 nanometers, or from 100 nanometers to 20 nanometers.

While typical cross-sections of the fibers are circular or elliptic in nature, they can be formed in other shapes by controlling the shape and size of the openings in a fiber producing device (described below). Fibers may include a blending of multiple materials. Fibers may also include holes (e.g., lumen or multi-lumen) or pores. Multi-lumen fibers may be achieved by, for example, designing one or more exit openings to possess concentric openings. In certain embodiments, such openings may include split openings (that is, wherein two or more openings are adjacent to each other; or, stated another way, an opening possesses one or more dividers such that two or more smaller openings are made). Such features may be utilized to attain specific physical properties, such as thermal insulation or impact absorbance (resilience). Nanotubes may also be created using methods and apparatuses discussed herein.

Fibers may be analyzed via any means known to those of skill in the art. For example, Scanning Electron Microscopy (SEM) may be used to measure dimensions of a given fiber. For physical and material characterizations, techniques such as differential scanning calorimetry (DSC), thermal analysis (TA) and chromatography may be used.

In particular embodiments, a fiber of the present fibers is not a lyocell fiber. Lyocell fibers are described in the literature, such as in U.S. Pat. Nos. 6,221,487, 6,235,392, 6,511,930, 6,596,033 and 7,067,444, each of which is incorporated herein by reference.

In one embodiment, microfibers and nanofibers may be produced substantially simultaneously. Any fiber producing device described herein may be modified such that one or more openings has a diameter and/or shape that produces nanofibers during use, and one or more openings have a diameter and/or shape that produces microfibers during use. Thus, a fiber producing device, when rotated will eject material to produce both microfibers and nanofibers. In some embodiments, nozzles may be coupled to one or more of the openings. Different nozzles may be coupled to different openings such that the nozzles designed to create microfibers and nozzles designed to create nanofibers are coupled to the openings. In an alternate embodiment, needles may be coupled (either directly to the openings or via a needle port). Different needles may be coupled to different openings such that needles designed to create microfibers and needles designed to create nanofibers are coupled to the openings. Production of microfibers and nanofibers substantially simultaneously may allow a controlled distribution of the fiber size to be achieved, allowing substantial control of the properties of products ultimately produced from the microfiber/nanofiber mixture.

After production of fibers is completed, it is desirable to clean the fiber producing device to allow reuse of the system. Generally, it is easiest to clean a fiber producing device when the material is in a liquid state. Once the material reverts to a solid, cleaning may be difficult, especially cleaning up small diameter nozzles and or needles coupled to the fiber producing device. The difficulty, especially with melt spinning, is that cleanup may also be difficult when the device is at an elevated temperature, especially if the fiber producing device needs to be cooled prior to handling for clean up. In some embodiments, a purge system may be couplable to fiber producing device when the fiber producing device is heated. A purge system may provide an at least partial seal between the purge system and the body of a fiber producing device such that a gas may be directed into the body, through the purge system, to create a pressurized gas inside of the body. The purge system, in some embodiments, includes a sealing member couplable to the body, a pressurized gas source, and a conduit coupling the pressurized gas source to the sealing member.

Microfibers and nanofibers produced using any of the devices and methods described herein may be used in a variety of applications. Some general fields of use include, but are not limited to: food, materials, electrical, defense, tissue engineering, biotechnology, medical devices, energy, alternative energy (e.g., solar, wind, nuclear, and hydroelectric energy); therapeutic medicine, drug delivery (e.g., drug solubility improvement, drug encapsulation, etc.); textiles/fabrics, nonwoven materials, filtration (e.g., air, water, fuel, semiconductor, biomedical, etc); automotive; sports; aeronautics; space; energy transmission; papers; substrates; hygiene; cosmetics; construction; apparel, packaging, geotextiles, thermal and acoustic insulation.

In some embodiments, microfibers and/or nanofibers may be formed from polyalkylene polymers (e.g., polyethylene, polypropylene, etc.). Polyalkylene microfibers and/or nanofibers may be used in a number of products and applications. Exemplary, non-limiting products and applications that may use polyalkylene microfibers and/or nanofibers include: nonwoven liquid barriers; surgical barriers that are gamma sterilizable; liquid filters; air filters; thermal bonding; food packaging (using e.g., high molecular weight polyethylene, "HMWPE"); medical device packaging (using e.g., HMWPE); moisture resistant building insulation (using e.g., HMWPE); breathable barrier fabrics (e.g., for apparel), and battery separators.

Some products that may be formed using microfibers and/or nanofibers include but are not limited to: filters using charged nanofiber and/or microfiber polymers to clean fluids; catalytic filters using ceramic nanofibers ("NF"); carbon nanotube ("CNT") infused nanofibers for energy storage; CNT infused/coated NF for electromagnetic shielding; mixed micro and NF for filters and other applications; polyester infused into cotton for denim and other textiles; metallic nanoparticles or other antimicrobial materials infused onto/coated on NF for filters; wound dressings, cell growth substrates or scaffolds; battery separators; charged polymers or other materials for solar energy; NE for use in environmental clean-up; piezoelectric fibers; sutures; chemical sensors; textiles/fabrics that are water & stain resistant, odor resistant, insulating, self-cleaning, penetration resistant, anti-microbial, porous/breathing, tear resistant, and wear resistant; force energy absorbing for personal body protection armor; construction reinforcement materials (e.g., concrete and plastics); carbon fibers; fibers used to toughen outer skins for aerospace applications; tissue engineering substrates utilizing aligned or random fibers; tissue engineering Petri dishes with aligned or random nanofibers; filters used in pharmaceutical manufacturing; filters combining microfiber and nanofiber elements for deep filter functionality; hydrophobic materials such as textiles; selectively absorbent materials such as oil booms; continuous length nanofibers (aspect ratio of more than 1,000 to 1); paints/stains; building products that enhance durability, fire resistance, color retention, porosity, flexibility, anti microbial, bug resistant, air tightness; adhesives; tapes; epoxies; glues; adsorptive materials; diaper media; mattress covers; acoustic materials; and liquid, gas, chemical, or air filters.

Fibers may be coated after formation. In one embodiment, microfibers and/or nanofibers may be coated with a polymeric or metal coating. Polymeric coatings may be formed by spray coating the produced fibers, or any other method known for forming polymeric coatings. Metal coatings may be formed using a metal deposition process (e.g., CVD).

In one embodiment, the systems and methods described herein may be used to form polysaccharide microfibers and/or nanofibers. As used herein the term "polysaccharide" refers to a linear chain of at least one hundred $\beta(1\rightarrow4)$ linked D-glucose units. Polysaccharides that may be formed into fibers include, but are not limited to, naturally occurring polysaccharides (e.g., cellulose and chitosan) and derivatives of cellulose. Examples of cellulose derivatives include, but are not limited to, cellulose esters and cellulose ethers. Examples of cellulose esters that may be formed into fibers include, but are not limited to: cellulose acetate; cellulose triacetate; cellulose propionate; cellulose acetate propionate; cellulose acetate butyrate; cellulose nitrate; and cellulose sulfate. Examples of cellulose ethers that may be formed into fibers include, but are not limited to: methylcellulose; ethylcellulose; ethyl methyl cellulose; hydroxyethyl cellulose; hydroxypropyl cellulose; hydroxyethyl methyl cellulose; hydroxypropyl methyl cellulose; ethyl hydroxyethyl cellulose; carboxymethyl cellulose; and croscarmellose sodium.

Polysaccharides have generally been found to be difficult to form into fibers using centrifugal spinning techniques. Generally polysaccharide fiber formation was found to be difficult and generally non-reproducible. Polysaccharide fibers may be formed using electrospinning techniques, however, electrospinning polysaccharide fibers suffers from the typical drawbacks of electrospinning (e.g., high cost, not amendable to mass production, high energy usage, requires specialized compositions, etc.).

In one embodiment, polysaccharides may be formed into microfibers and/or nanofibers by using solution centrifugal spinning techniques. In an embodiment, a composition comprising a polysaccharide and a carrier dissolved in a solvent is formed and placed into a fiber producing device having one or more openings. In some embodiments, the composition may be a composition that consists essentially of a polysaccharide and a carrier dissolved in a solvent. In some embodiments, the composition may be a composition that consists of a polysaccharide and a carrier dissolved in a solvent. The fiber producing device may be a fiber producing device as described in any embodiment set forth herein. After placing the composition in the fiber producing device, the device is rotated about a spin axis of the fiber producing device to cause at least a portion of the composition disposed in the fiber producing device to be ejected through the one or more openings and form fibers comprising polysaccharide and the carrier as the ejected composition solidifies. The formed fibers may be collected using one or more of the techniques set forth herein.

Exemplary carriers include carrier polymers and plasticizers. Examples of carrier polymers includes, but is not limited to, polyethylene oxide (PEO). polyethylene glycol (PEG), polyvinyl acetate (PVA), polyvinylpyrrolidone (PVP), and polypropylene glycol (PPG). Plasticizers may be used with a carrier polymer or may be used alone with the polysaccharide to form polysaccharide fibers. Examples of plasticizers include, but are not limited to, phthalate-based plasticizers (e.g., dicyclohexyl phthalate and dibutyl phthalate) and citric acid based plasticizers (e.g., trioctyl citrate, tributyl citrate, and triethyl citrate).

Polyethylene oxides that may be used as a carrier include polyethylene oxides having an average molecular weight of at least 20,000 g/mol. The use of polyethylene oxide has been found to act as a copolymer that aids in the formation of the fibers. Specifically, it was found that forming fibers from a composition that consists of a polysaccharide dissolved in a solvent led to poor quality fibers being formed. It was also found that the process of forming fibers from a composition that consists of a polysaccharide dissolved in a solvent was largely non-reproducible. Addition of various amounts of polyethylene oxide to a composition of a polysaccharide in a solvent has been shown to improve the quality of the polysaccharide polymers and the reproducibility of the process. In an embodiment, the weight % ratio of polysaccharide to polyethylene oxide in the composition ranges from about 50:50 to about 99:1.

Solvents that may be used include any solvents having a boiling point of less than about 200 C and that dissolve the polysaccharide and the polyethylene oxide. Exemplary solvents that may be used include, but are not limited to, acetone, methanol, ethanol, isopropanol, n-propanol, n-butanol, dimethyl sulfoxide (DMSO), dimethylacetamide (DMA), dimethylformamide (DMF), polyethylene glycol, tetrahydrofuran, ethyl acetate, acetonitrile, propylene carbonate, methyl ethyl ketone, water and mixtures thereof.

The average diameter of the fibers is, in part, controlled by the concentration of the polymeric components (i.e., polysaccharide and polyethylene oxide) in the solvent. In an embodiment the weight % of solids (e.g., polysaccharide/polyethylene oxide) to solvent ranges from about 2% to about 30%. Compositions having more than 30% solids were generally found to be too viscous for consistent centrifugal spinning Compositions having less than 2% solids were generally found to be too dilute for fiber formation.

The average diameter of the fibers may be controlled by controlling the viscosity of the composition. In an embodiment, the concentration of solids and/or the solvent used is selected to create a composition having a viscosity ranging from about 100 cP to about 10,000 cP. Compositions having a low viscosity lead to fibers having a small average diameter (e.g., between about 300 nm-5 microns). Higher viscosity compositions lead to fibers having a larger average diameter (e.g., 10-20 microns). By selecting the appropriate viscosity or concentration of components in the composition, the average fiber diameter of the produced fibers can be controlled to range from 300 nm up to 20 microns.

In one embodiment, improved fiber production can be seen when the composition is filtered prior to placing the composition in the fiber producing device. Filtration is used to remove micro-gel and undissolved polymeric components in the composition. More consistent fiber diameters and morphology is obtained when the composition is filtered prior to use. In one embodiment, filtration is performed by passing the composition through a wire mesh having a micron rating of between about 2 microns to about 50 microns. Contaminants may also be removed by filtering the solvent before the polymeric components are dissolved in the solvent. In one embodiment, the solvent may be filtered prior to use by passing the solvent through a wire mesh having a micron rating of between about 2 microns to about 50 microns. In a preferred embodiment, the solvent is filtered prior to use and the composition, formed using the filtered solvent, is also filtered prior to use.

In an embodiment, the composition is conditioned prior to placing the composition in the fiber producing device. Conditioning is accomplished by heating the composition to a temperature that is substantially equal to the temperature used during centrifugal spinning of the composition (the "processing temperature"). This minimizes temperature changes to the composition during processing. If the temperature of the composition changes by a significant amount (e.g., plus/minus 5 degrees) the viscosity of the composition may change leading to fibers having unexpected average diameters. In an embodiment, the composition is held at the processing temperature for a time of about 30 minutes to about 5 hours prior to use. Typical processing temperatures used to produce polysaccharide fibers range from about 25° C. to about 100° C.

In order to ensure that the composition remains at the processing temperature during fiber production, the fiber producing device may be independently heated to a temperature that will maintain the temperature of the composition at the processing temperature. In some embodiments, the temperature of the fiber producing device may be different (e.g., higher) than the processing temperature to compensate for the cooling effect of the fiber producing device spinning at high rotational speeds.

The fiber producing device generally includes openings having a diameter ranging from about 100 microns to about 500 microns. The diameter of the openings, the viscosity of the composition, and the rotational speed of the fiber producing device, all contribute to determining the morphology and the size of the produced fibers. To adjust the morphology and/or size of the produced fibers, one or more of these parameters may be adjusted.

Polysaccharide microfibers and/or nanofibers may be used in a number of products and applications. Exemplary, non-limiting products and applications that may use polysaccharide microfibers and/or nanofibers include: wound dressings, tissue scaffolds (e.g., stents); drug delivery; water filters; antimicrobial wipes; and sutures.

EXAMPLES

The following examples are included to demonstrate preferred embodiments of the invention. It should be appreciated by those of skill in the art that the techniques disclosed in the examples which follow represent techniques discovered by the inventor to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

Formation of Cellulose Acetate/Polyethylene Oxide Fibers

1. Composition Formation

Various compositions of cellulose acetate and polyethylene oxide in acetone or acetone DMA were formed. Acetone (or a combination of acetone and DMA) was filtered through a 30 micron mesh wire to remove any solid contaminants. Alternatively, formic acid, or a combination of formic acid and DMF may be used as the solvent. Cellulose acetate, polyethylene oxide and the filtered acetone were introduced into a closed mixing vessel and stirred for 4 hours at a temperature of 50° C. (or lower). After a substantially homogenous solution is obtained, the final weight/volume of the composition was checked to determine the amount (if any) of solvent loss (e.g., acetone). Additional filtered solvent was added to the composition to ensure that the concentration of polymer is at the desired value.

After the composition was formed, the composition was filtered through a 30 micron mesh wire to remove any micro-gel and undissolved polymer contaminants.

The filtered composition was subjected to conditioning to bring the composition to processing temperature. The processing temperature for cellulose acetate/polyethylene oxide in acetone was 50° C. Conditioning of the composition was accomplished by placing the composition in a water bath held at 50° C. or lower for 1-2 hours, with the composition sealed to prevent solvent loss. Prior to use the composition was subjected to a viscosity check to ensure that the composition viscosity was in the expected range.

2. Fiber Production

The conditioned composition was placed in a fiber producing device of FIG. 1A/1B. The fiber producing device has an orifice size of 150 μm or 300 μm. The fiber producing device was spun at a speed of about 6500 RPM to produce fibers that are composed of a mixture of cellulose acetate and polyethylene oxide. Exemplary compositions and properties of the resulting fibers are set forth in the tables below.

Table 1 shows the effect of solids weight percent on fiber size. A composition composed of a polymer blend composed of 95 wt % cellulose acetate (CA) and 5 wt % polyethylene oxide dissolved at a solids weight percent in acetone varying from 6% to 16% was placed in a fan type fiber producing device (see e.g., FIG. 1A/1B) having openings with an orifice diameter of 150 μm. From the results presented in Table 1 it can be seen that as the solids weight percentage is increased, the average fiber diameter increases.

TABLE 1

| Example | Polymer (CA:PEO) | % WT/WT of Polymer to Solvent (Acetone) | RPM | Spinneret | Orifice Size | Fiber Diameter (Microns) |
|---|---|---|---|---|---|---|
| 1A | 95:5 | 6 | 6500 | Fan | 150 | 0.985 |
| 1B | 95:5 | 7 | 6500 | Fan | 150 | 1.42 |
| 1C | 95:5 | 8 | 6500 | Fan | 150 | 1.93 |
| 1D | 95:5 | 9 | 6500 | Fan | 150 | 2.34 |
| 1E | 95:5 | 12 | 6500 | Fan | 150 | 5.87 |
| 1F | 95:5 | 14 | 6500 | Fan | 150 | 10.75 |
| 1G | 95:5 | 16 | 6500 | Fan | 150 | 17.02 |

FIGS. 11A-11G depict photographs of the fibers produced under each of the experimental conditions (1A-1G respectively). As can be seen from the photographs, fiber diameter and morphology change as the concentration of solids is changed.

Figure 12:
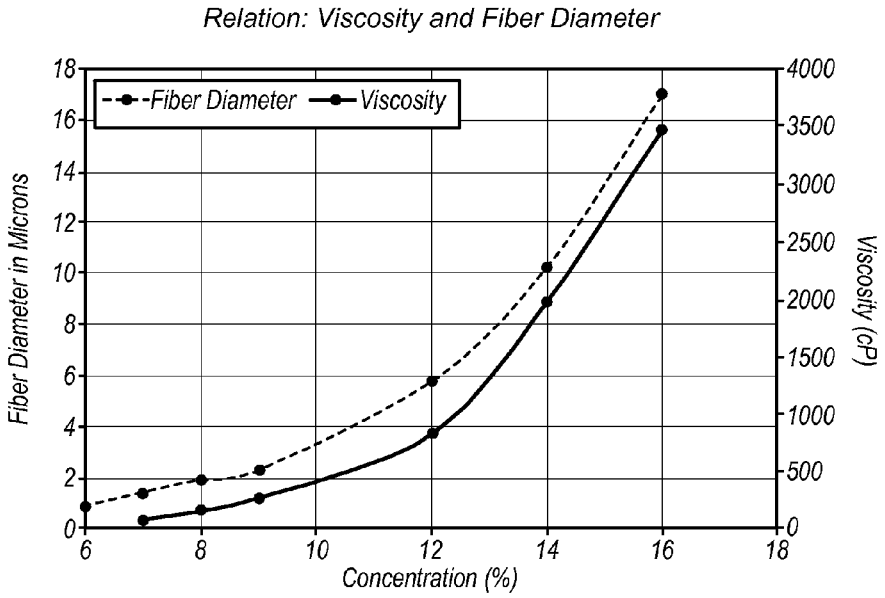
FIG. 12 depicts a graph of solids concentration vs. viscosity and fiber diameter.

The viscosity of each exemplary composition (Examples 1A-1G) was measured prior to placing in the fiber producing device. FIG. 12 depicts a graph of solids concentration vs. viscosity and fiber diameter. As can be seen from FIG. 12, as the solids concentration increase both the viscosity and the fiber diameter increase. A chart, such as the chart presented in FIG. 12, may be used to preselect a desired viscosity of the composition to form fibers having a desired size.

Figure 13A:
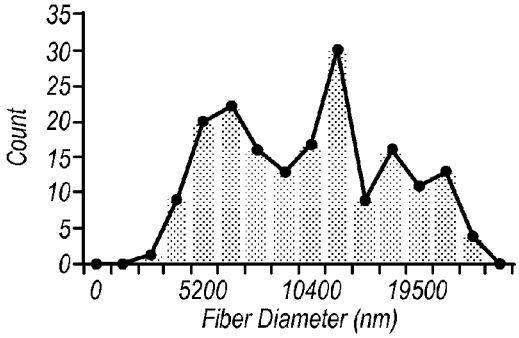
FIG. 13A depicts a histogram of the fiber diameter of fibers produced from experiment 2A.
Figure 13B:
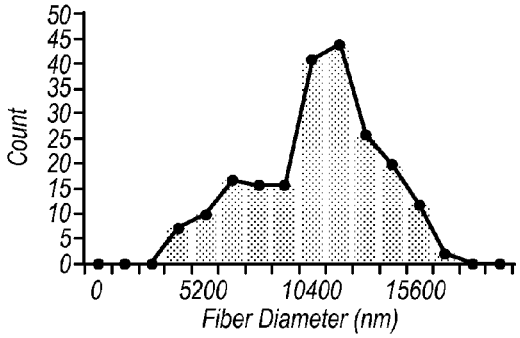
FIG. 13B depicts a histogram of the fiber diameter of fibers produced from experiment 2B.

In another study the effect of the ratio of cellulose acetate to polyethylene oxide was studied. The results of the second experiment are presented in Table 2. In experiment 2A a wt % ratio of cellulose acetate to polyethylene oxide was set at 95:5, while in experiment 2B the wt % ratio was changed to 80:20. FIG. 13A depicts a histogram of the fiber diameter of fibers produced from experiment 2A. FIG. 13B depicts a histogram of the fiber diameter of fibers produced from experiment 2B. Increasing the amount of polyethylene oxide has a negligible effect on the average fiber diameter, but a significant effect on the fiber size distribution. Increased amounts of polyethylene oxide produce a significantly narrow fiber distribution than fibers produced using lower amounts of polyethylene oxide. While the average fiber diameter did not change, the morphology of the fibers changes based on the PEO content of the fiber. For example, when the PEO content is less than 5% by weight, the fibers have a ribbon-like structure. When the PEO content is greater than 10% the fibers tend to have a cylindrical structure.

TABLE 2

| Example | Polymer (CA:PEO) | % WT/WT of Polymer to Solvent (Acetone) | RPM | Spinneret | Orifice Size | Fiber Diameter (microns) |
|---|---|---|---|---|---|---|
| 2A | 95:5 | 14 | 6500 | Fan | 150 | 10.61 |
| 2B | 80:20 | 13 | 6500 | Fan | 150 | 10.04 |

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A method of producing microfibers and/or nanofibers, comprising:

placing a composition into a fiber producing device comprising one or more openings, wherein the composition comprises a polysaccharide, a carrier and a solvent capable of dissolving at least a portion of the polysaccharide and the carrier; and rotating the fiber producing device about a spin axis such that rotation of the fiber producing device causes at least a portion of the composition disposed in the fiber producing device to be ejected through the one or more of the openings and form fibers comprising the polysaccharide as the ejected composition solidifies;

collecting at least a portion of the produced microfibers and/or nanofibers; and wherein the weight % of polysaccharide/carrier to solvent ranges from 2% to about 30%.

2. The method of claim 1, wherein the polysaccharide is a cellulose ester.

3. The method of claim 1, wherein the polysaccharide is cellulose acetate.

4. The method of claim 1, wherein the carrier is a polymer.

5. The method of claim 1, wherein the carrier comprises polyethylene oxide.

6. The method of claim 1, wherein the solvent comprises acetone.

7. The method of claim 1, wherein the solvent is a mixture of acetone and dimethylacetamide.

8. The method of claim 1, wherein the solvent is a mixture of two or more solvents.

9. The method of claim 1, wherein the weight % ratio of polysaccharide to the carrier in the composition ranges from about 50:50 to about 99:1.

10. The method of claim 1, further comprising:

forming a composition of the polysaccharide and a polyethylene oxide carrier in the solvent by mixing the components at a temperature of between about 25° C. and 100° C. for a time of about 1 hour to about 8 hours; and filtering the formed composition through a wire mesh having micron rating of between about 2 microns to about 50 microns.

11. The method of claim 10, further comprising conditioning the composition by heating the composition to a processing temperature and allowing the composition to remain at the processing temperature for a time of about 30 minutes to about 5 hours.

12. The method of claim 10, further comprising conditioning the composition by heating the composition to a temperature of between about 25° C. and 100° C. for a time of about 30 minutes to about 5 hours prior to placing the composition into the fiber producing device.

13. The method of claim 1, further comprising heating the fiber producing device to a temperature sufficient to maintain the temperature of the material disposed in the fiber producing device at a temperature above about 25° C.

14. The method of claim 1, further comprising activating a substrate transfer system to move at least a portion of a substrate over a substrate support positioned below the fiber producing device.

15. The method of claim 1, wherein the fibers produced have an average diameter ranging from about 300 nm to about 20 microns.

16. A method of producing microfiber and/or nanofibers, comprising:

placing a composition into a fiber producing device comprising one or more openings, wherein the composition comprises a polysaccharide, a carrier and a solvent capable of dissolving at least a portion of the polysaccharide and the carrier;

altering the viscosity of the composition to a preselected viscosity by altering the ratio of polysaccharide/carrier to solvent prior to placing the composition in the fiber producing device, wherein the preselected viscosity produces fibers having a predetermined average diameter;

rotating the fiber producing device about a spin axis such that rotation of the fiber producing device causes at least a portion of the composition disposed in the fiber producing device to be ejected though the one or more of the opening and from fibers comprising the polysaccharide as the ejected comprising solidifies:

activating a substrate transfer system to move at least a portion of the substrate over a substrate support positioned below the fiber producing device; and collecting at least a portion of the produced microfibers and/or nanofibers.

* * * * *